US005204213A

United States Patent [19]

Okada et al.

[11] Patent Number: 5,204,213

[45] Date of Patent: Apr. 20, 1993

[54] SILVER HALIDE PHOTOGRAPHIC MATERIAL

[75] Inventors: Hisashi Okada; Morio Yagihara, both of Kanagawa, Japan

[73] Assignee: Fuji Photo Film Co., Ltd., Kanagawa, Japan

[21] Appl. No.: 655,574

[22] Filed: Feb. 13, 1991

[30] Foreign Application Priority Data

Feb. 14, 1990 [JP] Japan ..... 2-32770
Feb. 15, 1990 [JP] Japan ..... 2-34736

[51] Int. Cl.[5] ..... G03C 5/54; G03C 1/34; G03C 1/06; G03C 7/26

[52] U.S. Cl. ..... 430/264; 430/222; 430/542; 430/512; 430/517; 430/558; 430/559; 430/564; 430/566; 430/606; 430/613; 430/623; 430/631; 430/955; 430/957; 430/959

[58] Field of Search ..... 430/222, 955, 957, 959, 430/219, 542, 264, 558 A, 559, 512, 606, 613, 623, 631, 564, 566, 517

[56] References Cited

U.S. PATENT DOCUMENTS

| | | | |
|---|---|---|---|
| 3,719,488 | 3/1973 | Locatell et al. | 430/222 |
| 3,719,489 | 3/1973 | Cieciuch et al. | 430/222 |
| 4,060,417 | 11/1977 | Cieciuch et al. | 430/214 |
| 4,098,783 | 7/1978 | Cieciuch et al. | 430/222 |
| 4,468,448 | 8/1984 | Rogers | 430/222 |
| 4,468,449 | 8/1984 | Arbree et al. | 430/222 |
| 4,468,450 | 8/1984 | Meneghini et al. | 430/222 |
| 4,468,451 | 8/1984 | Foley | 430/222 |
| 4,481,277 | 11/1984 | Pfingston | 430/222 |
| 4,535,051 | 8/1985 | Simon et al. | 430/222 |
| 4,656,286 | 4/1989 | MacGregor et al. | 548/146 |
| 4,740,448 | 4/1988 | Kliem | 430/222 |

*Primary Examiner*—Richard L. Schilling
*Attorney, Agent, or Firm*—Sughrue, Mion, Zinn, Macpeak & Seas

[57] ABSTRACT

A silver halide photographic material comprising at least one silver halide emulsion layer on a support, characterized in that there is contained a compound represented by the general formula (I)

wherein $R^1$ and $R^2$ each represents a hydrogen atom, aliphatic group, aromatic group or heterocyclic group, with the proviso that $R^1$ and $R^2$ may be connected to each other to form a ring; L represents a divalent linking group; V represents a carbonyl group, group, sulfonyl group, sulfoxy group, group (in which $R_0$ represents an alkoxy group or aryloxy group), iminomethylene group or thiocarbonyl group; Time represents a divalent linking group; m represents an integer 0 or 1; n represents an integer 0 or 1; PUG represents a photographically useful group; and X represents an atomic group required to form a 5- or 6-membered ring with (Abstract continued on next page.)

-continued
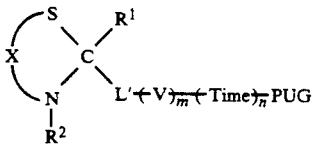
(II)
wherein $R^1$, $R^2$, V, m, n and Time are defined above; L′ represents a divalent linking group; and X represents an atomic group required to form a 5- or 6-membered ring with
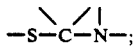
and PUG represents photographically useful groups set forth in the specification.
10 Claims, No Drawings

SILVER HALIDE PHOTOGRAPHIC MATERIAL

FIELD OF THE INVENTION

The present invention relates to a silver halide photographic material. More particularly, the present invention relates to a silver halide photographic material comprising a compound capable of rendering a photographically useful group usable upon development.

BACKGROUND OF THE INVENTION

A photographically useful reagent exerts different effects when previously incorporated in a photographic light-sensitive material from when incorporated in a processing solution. For example, a photographic reagent which is subject to decomposition in an acidic or alkaline or oxidizing or reducing atmosphere and cannot withstand a prolonged storage in a processing solution can be effectively used while the processing solution composition can be simplified and easily prepared. Furthermore, a necessary photographic reagent can exert its effects only on necessary sites, i.e., certain layers or their adjacent layers in the multi-layer light-sensitive material. Moreover, the content of a photographic reagent can be altered as a function of development of silver halide.

However, when incorporated in an active form, a photographic reagent reacts with other components in the photographic light-sensitive material during storage before development or decomposes under the effect of heat or oxygen and thus cannot often exert expected effects during development. An approach for overcoming such a difficulty is to incorporate such a photographic reagent in the photographic light-sensitive material in the form of substantially inactivated form attained by blocking the active group therein, i.e., in the form of photographic reagent precursor. If such a useful photographic reagent is a fog inhibitor or development inhibitor, the active group can be blocked to inhibit the adsorption thereof by a light-sensitive silver halide in storage or the desensitizing effect by the formation of silver salts as well as to release such a reagent at a required time. This results in an advantage that fogging can be reduced without impairing sensitivity, excess development fogging can be inhibited, or development can be suspended at a required time. If a useful photographic reagent is a developing agent, auxiliary developing agent or fogging agent, an active group or adsorption group contained therein can be blocked to inhibit various photographically dverse effects due to the production of semiquinone or oxide by air oxidation during storage or inhibit the production of fogged nucleus during storage due to the inhibition of electron injection into silver halide. This results in an advantage that a stable processing can be realized. If a photographic reagent is a bleach accelerator or blix accelerator, an active group contained therein can be blocked to inhibit the reaction thereof with other components contained therein. The blocking group can be removed during development to cause required properties to be accomplished at a necessary time.

As mentioned above, the use of a photographic reagent precursor is extremely effective for the full accomplishment of the properties of a photographic reagent. However, such a photographic reagent precursor must meet extremely strict requirements. In other words, the precursor must meet conflicting requirements. In particular, the precursor must occur stably in a photographic light-sensitive material during storage. On the other hand, when the photographic light-sensitive material is processed, the blocking group is removed at a necessary time to cause the photographic reagent to be readily and effectively released.

Some approaches for blocking photographic reagents have already been known. For example, blocking groups such as acyl group and sulfonyl group can be used as disclosed in JP-B-48-9968 and JP-B-47-44805 (U.S. Pat. No. 3,615,617) (the term "JP-B" as used herein means an "examined Japanese patent publication"), JP-A-52-8828 and JP-A-57-82834 (the term "JP-A" as used herein means an "unexamined published Japanese patent application"), and U.S. Pat. No. 3,311,476. A blocking group which undergoes a so-called reverse Michael reaction to release a photographically useful reagent can be used as disclosed in JP-B-55-17369 (U.S. Pat. No. 3,888,677), JP-B-55-9696 (U.S. Pat. No. 3,791,830), and JP-B-55-34927 (U.S. Pat. No. 4,009,029), and JP-A-56-77842 (U.S. Pat. No. 4,307,175), JP-A-59-105642, and JP-A-59-105640. A blocking group which undergoes an intramolecular electron migration to release a photographically useful reagent with the production of quinonemethide or quinonemethide compounds can be used as disclosed in JP-B-54-39727, U.S. Pat. Nos. 3,674,478, 3,932,480, and 3,993,661, and JP-A-57-135944, JP-A-57-135945, and JP-A-57-136640. An intramolecular ring closure reaction can be utilized as disclosed in JP-A-55-53330 and JP-A-59-218439. The cleavage of a 5- or 6-membered ring can be used as disclosed in JP-A-57-76541 (U.S. Pat. No. 4,335,200), JP-A-57-135949, JP-A-57-179842, JP-A-59-137945, JP-A-59-140445, JP-A-59-219741, and JP-A-60-41034.

These known approaches are disadvantageous in that a photographic reagent precursor stable in storage releases a photographic reagent too slowly, requiring the processing with a high alkali as a pH value of 12 or more or in that even if a photographic reagent precursor can release a photographic reagent at a sufficient rate in a processing solution with a pH value of 9 to 12, it decomposes gradually during storage, loosing the effects of the precursor.

These disadvantages can be attributed to the fact that the release of a photographically useful reagent from the blocked photographic reagent must rely on the attack by $OH^-$ ions. In other words, if the conventional photographic light-sensitive material is developed at a pH value of 9 to 12, the difference in $OH^-$ ion concentration between during storage and processing of the photographic light-sensitive material is $10^2$ to $10^5$ because the pH value reaches 6 to 7 during storage. Accordingly, it is presumed that a blocked photographic reagent which releases a photographically useful group at a half-life period of 3 minutes (3 minutes are required for half the added amount of the photographic reagent to decompose) at a pH value of 10 for example decomposes at a half period of 3 minutes $\times 10^4$ (=30,000 minutes=about 500 hours) during storage (pH=6). This means that if a photographic reagent precursor is stored for about 3 weeks, about half the added amount thereof decomposes, making it impossible to put this system into practical use. A blocked compound which releases a photographic reagent at a half period of 3 minutes during processing at a pH value of 11 decomposes during storage at a half period of about 10 times (about 30 weeks) the case where the processing is effected at a pH value of 10. However, even this half period leaves much to be desired. Thus, these approaches cannot be put into practical use in view of preservability.

SUMMARY OF THE INVENTION

It is therefore an object of the present invention to provide a compound which keeps the active portion of a photographically useful group stably blocked during storage but can release a photographic reagent at a necessary time.

It is another object of the present invention to provide a silver halide color photographic material which exhibits an improved picture quality.

The above and other objects of the present invention will become more apparent from the following detailed description and examples.

The object of the present invention is accomplished with a silver halide photographic material comprising at least one silver halide emulsion layer on a support, characterized in that there is contained a compound represented by the general formula (I) or (II):

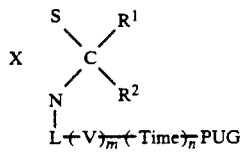

(I)

wherein $R^1$ and $R^2$ each represents a hydrogen atom, aliphatic group, aromatic group or heterocyclic group, with the proviso that $R^1$ and $R^2$ may be connected to each other to form a ring; L represents a divalent linking group; V represents a carbonyl group,

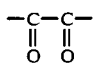

group, sulfonyl group, sulfoxy group,

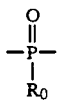

group (in which $R_0$ represents an alkoxy group or aryloxy group), iminomethylene group or thiocarbonyl group; Time represents a divalent linking group; m represents an integer 0 or 1; n represents an integer 0 or 1; PUG represents a photographically useful group; and X represents an atomic group required to form a 5- or 6-membered ring with

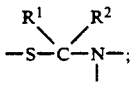

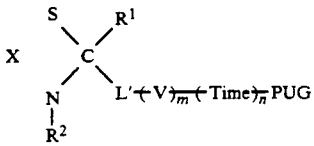

(II)

wherein $R^1$ and $R^2$ each represents a hydrogen atom, aliphatic group, aromatic group or heterocyclic group, with the proviso that $R^1$ and $R^2$ may be connected to each other to form a ring; L' represents a divalent linking group; V represents a carbonyl group,

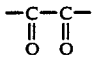

group, sulfonyl group, sulfoxy group,

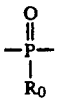

group (in which $R_0$ represents an alkoxy group or aryloxy group), iminomethylene group or thiocarbonyl group; Time represents a divalent linking group; m represents an integer 0 or 1; n represents an integer 0 or 1; and X represents an atomic group required to form a 5- or 6-membered ring with

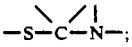

and PUG represents a fog inhibitor, development inhibitor, development accelerator, fogging agent, desilvering accelerator, desilvering inhibitor, silver halide solvent, developing agent, auxiliary developing agent, fixing accelerator, fixing inhibitor, image stabilizer, toner, processing dependency improver, dot improver, dye stabilizer, surface active agent, film hardener, desensitizer, contrast improver, chelating agent or DIR hydroquinone.

DETAILED DESCRIPTION OF THE INVENTION

The compounds represented by the general formulae (I) and (II) will be further described hereinafter.

The aliphatic group represented by $R^1$ or $R^2$ is a saturated or unsaturated, chain or cyclic, straight-chain or branched, substituted or unsubstituted aliphatic hydrocarbon group preferably containing 1 to 32 carbon atoms, more preferably 1 to 22 carbon atoms. Typical examples of such an aliphatic group include methyl, ethyl, propyl, 1-butyl, 1-pentyl, 1-hexyl, 1-heptyl, 1-octyl, 1-nonyl, 1-decyl, 1-undecyl, 1-dodecyl, 1-tridecyl, 1-tetradecyl, 1-pentadecyl, 1-hexadecyl, 1-heptadecyl, 1-octadecyl, 1-nonadecyl, 1-eicocyl, 2-propyl, 2-butyl, 2-pentyl, 3-pentyl, t-butyl, 1-(2-ethyl)-hexyl, cyclopentyl, cyclohexyl, cycloheptyl, cyclooctyl, vinyl, 1-butenyl, allyl, 1-hexenyl, and 1-hexynyl.

The aromatic group represented by $R^1$ or $R^2$ is preferably a $C_{6-20}$ aromatic group, more preferably a substituted or unsubstituted phenyl or naphthyl group.

The heterocyclic group represented by $R^1$ or $R^2$ is preferably a $C_{1-20}$, more preferably $C_{1-6}$ substituted or unsubstituted 3- to 7-membered heterocyclic group containing as hetero atoms nitrogen atom, oxygen atom or sulfur atom. Typical examples of such a heterocyclic group include 2-pyridyl, 4-pyridyl, 2-chenyl, 2-furyl, 2-imidazolyl, pyradinyl, 2-pyrimidinyl, 2-indolyl, 1,3,4-thiadiazole-2-il, benzoxazole-2-il, 2-quinolyl, 2,4-dioxo-1,3-imidazolidine-5-il, 1,2,4-triazole-3-il, and tetrazole-5-il.

Examples of substituents to be contained in the above mentioned aliphatic group, aromatic group and heterocyclic group include halogen atom (e.g., fluorine atom, chlorine atom), alkyl group (e.g., methyl, ethyl, isopropyl, 1-butyl, t-butyl, 1-octyl), aryl group (e.g., phenyl, p-tolyl, 4-nitrophenyl, 4-ethoxyphenyl, 1-naphthyl), heterocyclic group (e.g., 4-pyridyl, 2-furyl), hydroxyl group, alkoxy group (e.g., methoxy, ethoxy, 1-butoxy), aryloxy group (e.g., phenoxy, 4-methoxyphenoxy, 4-nitrophenoxy, 3-butanesulfonamidephenoxy, 2,5-di-t-amylphenoxy, 2-naphthoxy), heterocyclic oxy group (e.g., 2-furyloxy), acyloxy group (e.g., acetoxy, pivaloyloxy, benzoyloxy, dodecanoyloxy), alkoxycarbonyloxy group (e.g., ethoxycarbonyloxy, t-butoxycarbonyloxy, 2-ethyl-1-hexyloxycarbonyloxy), aryloxycarbonyloxy group (e.g., phenoxycarbonyloxy), carbamoyloxy group (N,N-dimethylcarbamoyloxy, N-butylcarbamoyloxy), sulfamoyloxy group (N,N-diethylsulfamoyloxy, N-propylsulfamoyloxy), sulfonyloxy group (e.g., methanesulfonyloxy, benzenesulfonyloxy), carboxyl group, acyl group (e.g., acetyl, pivaloyl, benzoyl), alkoxycarbonyl group (e.g., ethoxycarbonyl), aryloxycarbonyl group (e.g., phenoxycarbonyl), carbamoyl group (e.g., N,N-dibutylcarbamoyl, N-ethyl-N-octylcarbamoyl, N-propylcarbamoyl), amino group (e.g., amino, N-methylamino, N,N-dioctylamino), anilino group (e.g., N-methylanilino), heterocyclic amino group (e.g., 4-pyridylamino), amide group (e.g., acetamide, benzamide), urethane group (e.g., N-hexylurethane, N,N-dibutylphenylureide), urethane), ureide group (e.g., N,N-dimethylureide, N-phenylureide), sulfonamide group (e.g., butanesulfonamide, p-toluenesulfonamide), alkylthio group (e.g., ethylthio, octylthio), arylthio group (e.g., phenylthio, 4-dodecylphenylthio), sulfinyl group (e.g., benzenesulfinyl), sulfonyl group (e.g., methanesulfonyl, octanesulfonyl, p-toluenesulfonyl), sulfo group, cyano group, and nitro group. Among these substituents, amino group, anilino group and heterocyclic amino group may be in the form of quaternary ammonium salt, and carboxyl group and sulfo group may be in the form of alkaline metal salt or ammonium salt.

The divalent linking group represented by L in formula (I) is a group which undergoes an intramolecular nucleophilic substitution reaction of Ags—X—N—H—L—V—$_m$—Time—$_n$PUG or production of quinomonomethane analogous to render —Time—$_n$PUG releasable. Examples of such a group include alkylene group, alkenylene group, arylene group, heteroarylene group (optionally containing substituents), and combination thereof with —O—, —S—, $$-\underset{\underset{R^3}{|}}{N}-$$

(in which $R^3$ represents a hydrogen atom, alkyl group or aryl group), —N=, —CO—, —$SO_2$— or the like.

Preferred examples of the divalent linking group represented by L in formula (I) include those set forth below. The symbol (*) indicates the position at which the divalent linking group is connected to N in the general formula (I), and the symbol (*)(*) indicates the position at which it is connected to —(V)$_m$—(TIME)$_n$—PUG in the general formula (I).

(*)—$CH_2$—(*)(*), (*)—$CH_2CH_2$—(*)(*), (*)—$CH_2CH_2CH_2$—(*)(*), (*)—$CH_2CH_2CH_2CH_2$—(*)(*),

-continued

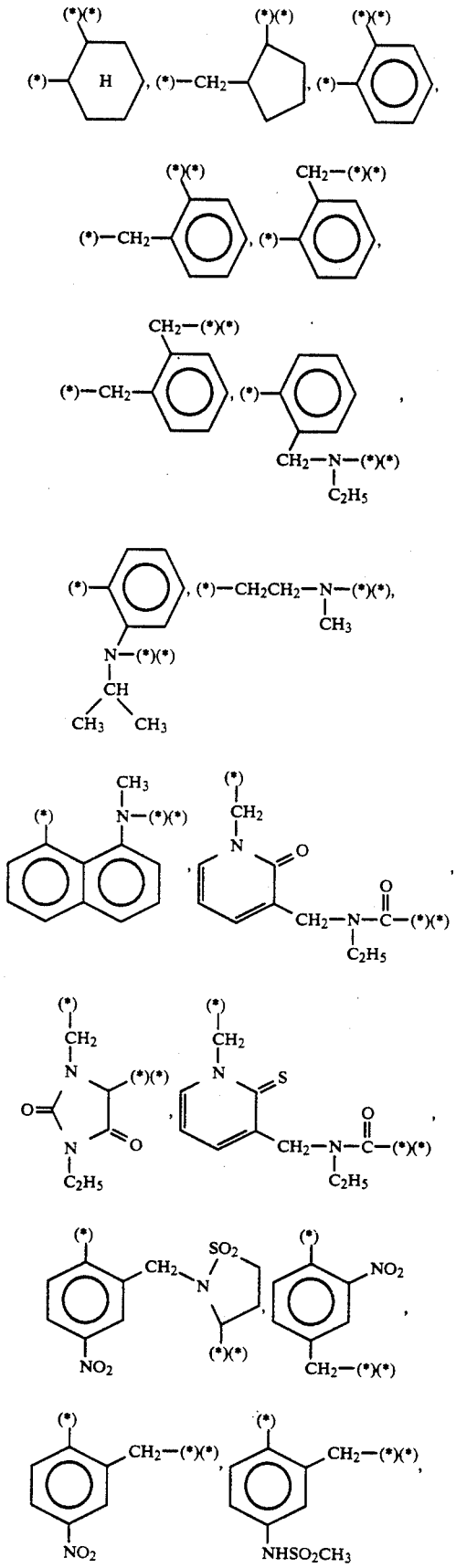

-continued

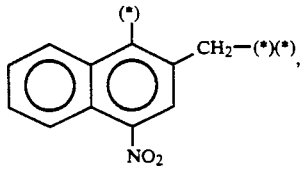

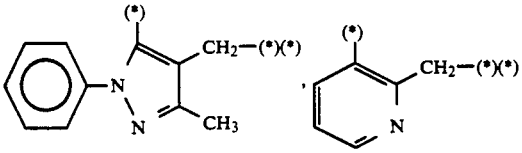

Particularly preferred among the divalent linking groups represented by L is the group which undergoes an intramolecular nucleophilic substitution reaction of AgS—X—NH—L—V—$_m$—Time—$_n$PUG or production to render (Time)$_n$—PUG releasable.

The divalent linking group represented by L' in formula (II) is a group which render (Time—$_n$PUG cleavable by an intramolecular nucleophilic reaction which is triggered by reaction of a nucleophilic agent with a carbonyl group of R'—C—L'—V—$_m$—Time—$_n$PUG produced by hydrolysis reaction of the compound of formula (II). Examples of such a group include alkylene group, alkenylene group, arylene group, heteroarylene group (optionally containing substituents), and combination thereof with —O—, —S—,

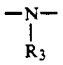

(in which $R^3$ represents a hydrogen atom, alkyl group or aryl group), —N=, —CO—, —$SO_2$— or the like.

Preferred examples of the divalent linking group represented by L' in formula (II) include those set forth below. The symbol (*) indicates the position at which the divalent linking group is connected to N in formula (II), and the symbol (*)(*) indicates the position at which it is connected to —V—$_m$—Time—$_n$PUG in formula (II).

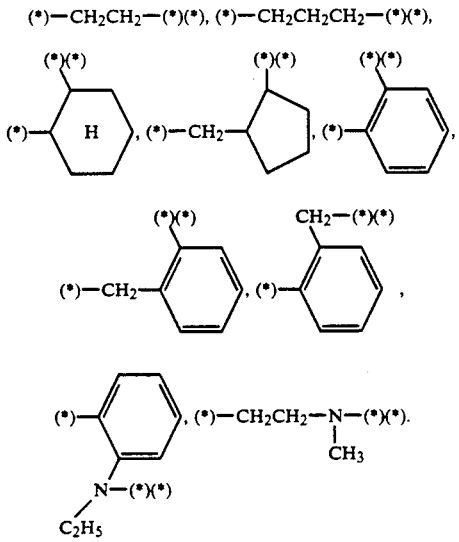

V represents a carbonyl group,

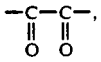

sulfonyl group, sulfoxy group,

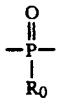

(in which $R_0$ represents an alkoxy group or aryloxy group), iminomethylene group or thiocarbonyl group. Preferred among these groups is carbonyl group.

Time represents a divalent linking group which may serve to adjust timing. The suffix n represents an integer 0 or 1. When n is 0 and m is 1, it means that PUG is directly connected to V. When n is 0 and m is 0, it means that PUG is directly connected to L.

The divalent linking group represented by Time is a group which releases PUG from the compound of the general formula (I) or (II) via one or more stage reaction.

Examples of the divalent linking group represented by Time include group which undergoes an intramolecular ring closure reaction of p-nitrophenoxy derivative to release a photographically useful group (PUG) as disclosed in U.S. Pat. No. 4,248,962 (JP-A-54-145135), group which undergoes an intramolecular ring closure reaction after ring cleavage to release PUG as disclosed in U.S. Pat. Nos. 4,310,612 (JP-A-55-53330) and 4,330,617, group which releases PUG with the production of an acid anhydride by an intramolecular ring closure reaction of succinic monoester or analogous as disclosed in U.S. Pat. Nos. 4,483,919, 4,446,216, and 4,483,919, and JP-A-59-121328, group which undergoes electronic migration of aryloxyl or heterocyclic oxy group via conjugated double bond to produce quinomonomethane or analogous thereof and release PUG as disclosed in U.S. Pat. Nos. 4,409,323, 4,421,845, and 4,416,977 (JP-A-57-135944), *Research Disclosure* No. 21228 (December 1981), and JP-A-58-209736 and JP-A-58-209738, group which undergoes electronic migration of the portion of a nitrogen-containing heterocyclic group containing an enamine structure to release PUG from the γ-position of 57-136640), and JP-A-57-135945, JP-A-57-188035, JP-A-58-98728, and JP-A-58-209737, group which undergoes an intramolecular ring closure reaction of an oxy group produced by electronic migration to a carbonyl group conjugated with a nitrogen atom in a nitrogen-containing heterocyclic group to release PUG as disclosed in JP-A-57-56837, group which releases PUG with the production of aldehydes as disclosed in U.S. Pat. No. 4,146,396 (JP-A-52-90932), and JP-A-59-93442 and 59-75475, group which releases PUG with the. decarboxylation of carboxyl group as disclosed in JP-A-51-146828, JP-A-57-179842, and JP-A-59-104641, group having the chemical structure —O—COOCRaRb—PUG which releases PUG with the production of aldehydes followed by decarboxylation, group which releases PUG with the production of isocyanate as disclosed in JP-A-60-7429, and group which undergoes coupling reaction with an oxidation product of a color developing agent to release PUG as disclosed in U.S. Pat. No. 4,438,193.

Specific examples of the divalent linking group represented by Time are further described in JP-A-61-236549. Preferred specific examples of such a divalent linking group include those described in JP-A-1-269936. Particularly preferred among these groups are T-(1) to T-(42) as set forth below.

The symbol (*) indicates the position at which —Time—$_n$PUG is connected to V if m is 1 or to L if m is 0. The symbol (*)(*) indicates the position at which the group is connected to PUG.

T-(1)

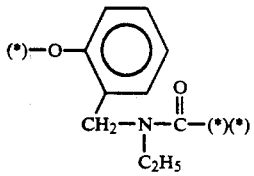

T-(2)

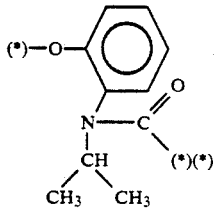

T-(5)

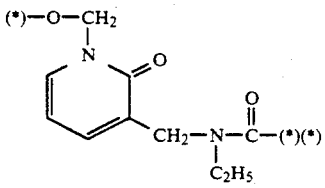

T-(6)

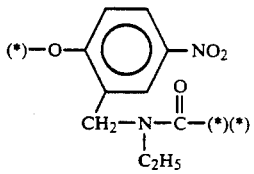

T-(7)

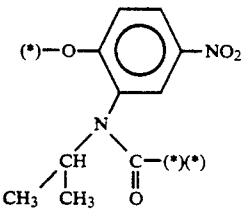

T-(8)

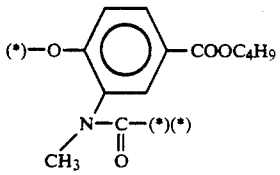

-continued

T-(9)

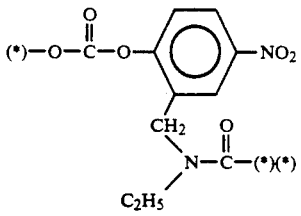

T-(10)

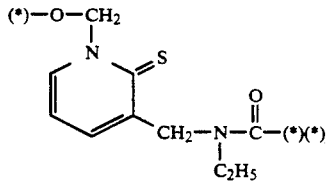

T-(14)

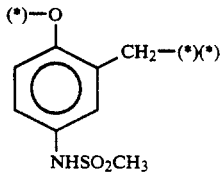

T-(15)

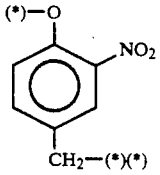

T-(17)

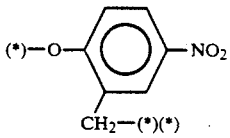

T-(20)

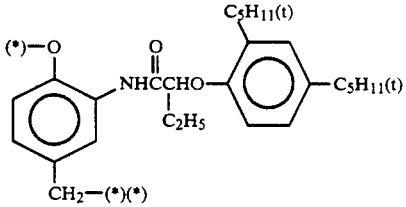

T-(26)

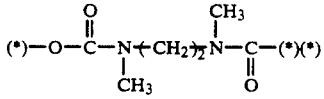

T-(31)

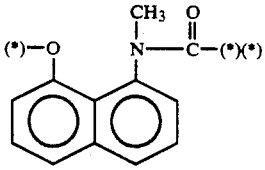

T-(33)

$R_1$, $R_2$, X, L, L' or Time may comprise a ballast group or polymer commonly used in immobile photographic additives such as coupler. Such a ballast group is an organic group which provides the compound of the general formula (I) or (II) with a molecular weight enough to be substantially incapable of being diffused into other layers or processing solution. Examples of such a ballast group include combinations of one or more of alkyl group, aryl group, heterocyclic group, ether group, thioether group, amide group, ureide group, urethane group, and sulfonamide group.

PUG represents a photographically useful group which serves as (Time—$_n$PUG.

Examples of such a photographically useful group include fog inhibitor, development inhibitor, development accelerator, fogging agent, coupler, coupler-releasing coupler, diffusive dye, nondiffusive dye, desilvering accelerator, desilvering inhibitor, silver halide solvent, competitive compound, developing agent, auxiliary developing agent, fixing accelerator, fixing inhibitor, image stabilizer, toner, processing dependency improver, dot improver, dye image stabilizer, photographic dye, surface active agent, film hardener, ultraviolet absorbent, fluorescent brightening agent, desensitizer, contrast improver, chelating agent, DIR hydroquinone, and precursor thereof.

Many of these photographically useful groups are duplicated in view of effectiveness. Typical examples of photographically useful groups will be further set forth below.

The fog inhibitor or development inhibitor represented by PUG or (Time—$_n$PUG is a known development inhibitor connected to the other portion of the compound (I) or (II) via hetero atoms. Preferred examples of such a development inhibitor are disclosed in C. E. K. Mees and T. H. James, "The Theory of Photographic Processes", 3rd ed., 1966, Macmillan, pp. 344–346, and Japanese Patent Application No. 1-114455. Specific examples of such a development inhibitor include mercaptotetrazoles, mercaptotriazoles, mercaptoimidazoles, mercaptopyrimidines, mercaptoimidazoles, mercaptobenzthiazole, mercaptobenzoxazoles, mercaptothiadiazoles, benztriazoles, benzimidazoles, indazoles, adenines, guanines, tetrazoles, tetraazaindenes, triazaindenes, and mercaptoaryls.

The fog inhibitor or development inhibitor represented by PUG may be substituted by substituents as set forth below. These substituents may be further substituents by other substituents.

Examples of such substituents include alkyl group, aralkyl group, alkenyl group, alkinyl group, alkoxy group, aryl group, substituted amino group, acylamino group, sulfonylamino group, ureide group, urethane group, aryloxy group, sulfamoyl group, carbamoyl group, alkylthio group, arylthio group, sulfonyl group, sulfinyl group, hydroxyl group, halogen atom, cyano group, sulfo group, alkyloxycarbonyl group, aryloxycarbonyl group, acyl group, alkoxycarbonyl group, acyloxy group, carboxyamide group, sulfonamide group, carboxyl group, sulfoxy group, phosphono group, phosphinico group, and phosphoric amide group.

The fog inhibitor or development inhibitor may be a compound which, after being released from a compound of the general formula (I) or (II) in the development step, becomes a development-inhibiting compound which in turn is converted to a compound substantially free of development inhibiting effect or little development inhibiting effect.

Examples of major fog inhibitors or development inhibitors will be set forth below.

1. Mercaptotetrazole derivatives (1) 1-Phenyl-5-mercaptotetrazole
(2) 1-(4-Hydroxyphenyl)-5-mercaptotetrazole
(3) 1-(4-Aminophenyl)-5-mercaptotetrazole
(4) 1-(4-Carboxyphenyl)-5-mercaptotetrazole
(5) 1-(4-Chlorophenyl)-5-mercaptotetrazole
(6) 1-(4-Methylphenyl)-5-mercaptotetrazole
(7) 1-(2,4-Dihydroxyphenyl)-5-mercaptotetrazole
(8) 1-(4-Sulfamoylphenyl)-5-mercaptotetrazole
(9) 1-(3-Carboxyphenyl)-5-mercaptotetrazole
(10) 1-(3,5-Dicarboxyphenyl)-5-mercaptotetrazole
(11) 1-(4-Methoxyphenyl)-5-mercaptotetrazole
(12) 1-(2-Methoxyphenyl)-5-mercaptotetrazole
(13) 1-[4-(2-Hydroxyethoxy)phenyl]-5-mercaptotetrazole
(14) 1-(2,4-Dichlorophenyl)-5-mercaptotetrazole
(15) 1-(4-Dimethylaminophenyl)-5-mercaptotetrazole
(16) 1-(4-Nitrophenyl)-5-mercaptotetrazole
(17) 1,4-Bis(5-mercapto-1-tetrazolyl)benzene
(18) 1-(α-naphthyl)-5-mercaptotetrazole
(19) 1-(4-Sulfonyl)-5-mercaptotetrazole
(20) 1-(3-Sulfophenyl)-5-mercaptotetrazole
(21) 1-(β-Naphthyl)-5-mercaptotetrazole
(22) 1-Methyl-5-mercaptotetrazole
(23) 1-Ethyl-5-mercaptotetrazole
(24) 1-Propyl-5-mercaptotetrazole
(25) 1-Octyl-5-mercaptotetrazole
(26) 1-Dodecyl-5-mercaptotetrazole
(27) 1-Cyclohexyl-5-mercaptotetrazole
(28) 1-Palmytyl-5-mercaptotetrazole
(29) 1-Carboxyethyl-5-mercaptotetrazole
(30) 1-(2,2-diethoxy)-5-mercaptotetrazole
(31) 1-(2-Aminoethyl)-5-mercaptotetrazole hydrochloride
(32) 1-(2-Diethylaminoethyl)-5-mercaptotetrazole
(33) 2-(5-Mercapto-1-tetrazole)ethyltrimethyl ammonium chloride
(34) 1-(3-Phenoxycarbonylphenyl)-5-mercaptotetrazole
(35) 1-(3-Maleinimidephenyl)-6-mercaptotetrazole 2. Mercaptotriazole derivatives (1) 4-Phenyl-3-mercaptotriazole
(2) 4-Phenyl-5-methyl-3-mercaptotriazole
(3) 4,5-Diphenyl-3-mercaptotriazole
(4) 4-(4-Carboxyphenyl)-3-mercaptotriazole
(5) 4-Methyl-3-mercaptotriazole
(6) 4-(2-Dimethylaminoethyl)-3-mercaptotriazole
(7) 4-(α-Naphthyl)-3-mercaptotriazole
(8) 4-(4-Sulfophenyl)-3-mercaptotriazole
(9) 4-(3-Nitrophenyl)-3-mercaptotriazole 3. Mercaptoimidazole derivatives (1) 1-Phenyl-2-mercaptoimidazole
(2) 1,5-Diphenyl-2-mercaptoimidazole
(3) 1-(4-Carboxyphenyl)-2-mercaptoimidazole
(4) 1-(4-Hexylcarbamoyl)-2-mercaptoimidazole
(5) 1-(3-Nitrophenyl)-2-mercaptoimidazole
(6) 1-(4-Sulfophenyl)-2-mercaptoimidazole 4. Mercaptopyrimidine derivatives (1) Thiouracil
(2) Methylthiouracil
(3) Ethylthiouracil
(4) Propylthiouracil
(5) Nonylthiouracil
(6) Aminothiouracil
(7) Hydroxythiouracil 5. Mercaptobenzimidazole derivatives (1) 2-Mercaptobenzimidazole
(2) 5-Carboxy-2-mercaptobenzimidazole
(3) 5-Amino-2-mercaptobenzimidazole
(4) 5-Nitro-2-mercaptobenzimidazole
(5) 5-Chloro-2-mercaptobenzimidazole
(6) 5-Methoxy-2-mercaptobenzimidazole
(7) 2-Mercaptonaphthoimidazole
(8) 2-Mercapto-5-sulfobenzimidazole
(9) 1-(2-Hydroxyethyl)-2-mercaptobenzimidazole
(10) 5-Caproamide-2-mercaptobenzimidazole
(11) 5-(2-Ethylhexanoylamino)-2-mercaptobenzimidazole 6. Mercaptothiadiazole derivatives (1) 5-Methylthio-2-mercapto-1,3,4-thiadiazole
(2) 5-Ethylthio-2-mercapto-1,3,4-thiadiazole
(3) 5-(2-Dimethylaminoethylthio)-2-mercapto-1,3,4-thiadiazole
(4) 5-(2-Carboxypropylthio)-2-mercapto-1,3,4-thiadiazole
(5) 2-Phenoxycarbonylmethylthio-5-mercapto-1,3,4-thiadiazole 7. Mercaptobenzthiazole derivatives (1) 2-Mercaptobenzthiazole
(2) 5-Nitro-2-mercaptobenzthiazole
(3) 5-Carboxy-2-mercaptobenzthiazole
(4) 5-Sulfo-2-mercaptobenzthiazole 8. Mercaptobenzoxazole derivatives (1) 2-Mercaptobenzoxazole
(2) 5-Nitro-2-mercaptobenzoxazole
(3) 5-Carboxy-2-mercaptobenzoxazole
(4) 5-Sulfo-2-mercaptobenzthiazole 9. Benztriazole derivatives (1) 5,6-Dimethylbenzotriazole
(2) 5-Butylbenzotriazole
(3) 5-Methylbenzotriazole
(4) 5-Chlorobenzotriazole
(5) 5-Bromobenzotriazole
(6) 5,6-Dichlorobenzotriazole
(7) 4,6-Dichlorobenzotriazole
(8) 5-Nitrobenzotriazole
(9) 4-Nitro-6-chloro-benzotriazole
(10) 4,5,6-Trichlorobenzotriazole
(11) 5-Carboxybenzotriazole
(12) Sodium salt of 5-sulfobenzotriazole
(13) 5-Methoxycarbonylbenzotriazole
(14) 5-Aminobenzotriazole
(15) 5-Butoxybenzotriazole
(16) 5-Ureidebenzotriazole
(17) Benzotriazole
(18) 5-Phenoxycarbonylbenzotriazole
(19) 5-(2,3-Dichloropropyloxycarbonyl)benzotriazole 10. Benzimidazole derivatives (1) Benzimidazole
(2) 5-Chlorobenzimidazole
(3) 5-Nitrobenzimidazole
(4) 5-n-Butylbenzimidazole
(5) 5-Methylbenzimidazole
(6) 4-Chlorobenzimidazole
(7) 5,6-Dimethylbenzimidazole
(8) 5-Nitro-2-(trifluoromethyl)benzimidazole 11. Indazole derivatives (1) 5-Nitroindazole
(2) 6-Nitroindazole
(3) 5-Aminoindazole
(4) 6-Aminoindazole
(5) Indazole
(6) 3-Nitroindazole
(7) 5-Nitro-3-chloroindazole
(8) 3-Chloro-5-nitroindazole
(9) 3-Carboxy-5-nitroindazole 12. Tetrazole derivatives (1) 5-(4-Nitrophenyl)tetrazole
(2) 5-Phenyltetrazole
(3) 5-(3-Carboxyphenyl)tetrazole 13. Tetrazaindene derivatives (1) 4-Hydroxy-6-methyl-5-nitro-1,3,3a,7-tetrazaindene
(2) 4-Mercapto-6-methyl-5-nitro-1,3,3a,7-tetrazaindene 14. Mercaptoaryl derivatives (1) 4-Nitrothiophenol
(2) Thiophenol
(3) 2-Carboxythiophenol Examples of the dye represented by PUG include compounds as described in "Kokino Photochemicals (High Function Photochemicals)—Kozokino to Oyotenbo (Structural Function and View of Application)", CMC, 1986, pp. 197–211.

Specific examples of photographic dyes include arylidene dye, styryl dye, butadiene dye, oxonol dye, cyanine dye, melocyanine dye, hemicyanine dye, diarylmethane dye, triarylmethane dye, azomethine dye, azo dye, anthraquinone dye, stilbene dye, chalkone dye, indophenol dye, indoaniline dye, coumarine dye, alizarin dye, nitro dye, quinoline dye, indigo dye, and phthalocyanine dye. These dyes may be used in leuco form. Furthermore, photographic dyes whose absorption wavelength have been temporarily shifted may be used. Dye precursors such as tetrazolium salt may be used. Moreover, these dyes may form chelate dyes with proper metals. These dyes are further described in U.S. Pat. Nos. 3,880,658, 3,931,144, 3,932,380, 3,932,381, and 3,942,987.

Specific examples of preferred dyes are Dye Nos. $D_1$ to $D_{40}$ described as dyes represented by PUG in JP-A-1-269936.

Besides these dyes, those disclosed in JP-A-59-201057, JP-A-61-95346 and JP-A-61-95347 can be used.

Examples of the development accelerator represented by PUG include those represented by the general formula (III):

$$(*)(*)(*)-L_1\leftarrow L_2\rightarrow_k A \qquad \text{(III)}$$

wherein the symbol (*)(*)(*) indicates the position at which it is connected to $-L-V)_m(Time-_n$; $L_1$ represents a group capable of being separated from Time which has been separated; L2 represents a divalent linking group; k represents an integer 0 or 1; and A represents a group which substantially exhibits a fogging effect on a silver halide emulsion in a processing solution.

Preferred examples of $L_1$ include aryloxy group, heterocyclic oxy group, arylthio group, alkylthio group, heterocyclic thio group, and azolyl group. Particularly preferred among these groups are heterocyclic oxy group, arylthio group, heterocyclic thio group, and azolyl group.
Specific examples of $L_1$ will be set forth below.
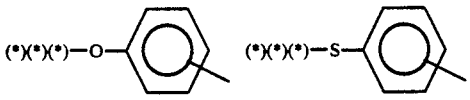
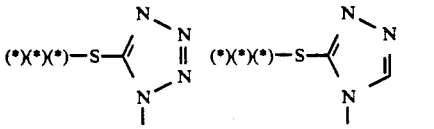
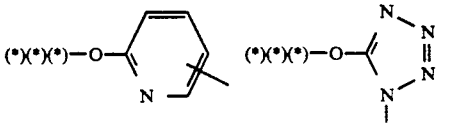
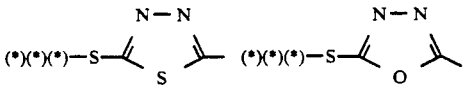
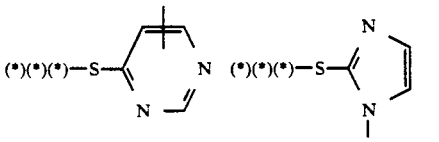
$(*)(*)(*)-S-(CH_2)_2-$, $(*)(*)(*)-S-(CH_2)_4-$
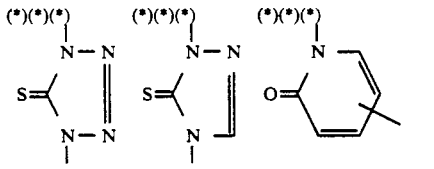
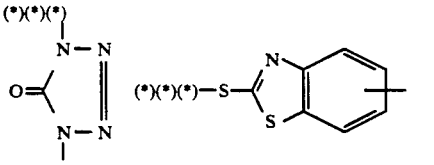
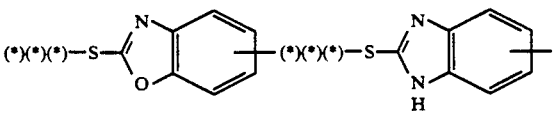
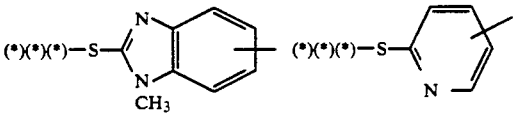
-continued
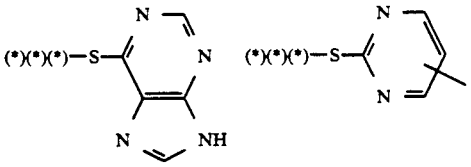
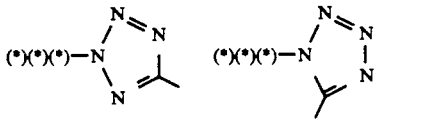
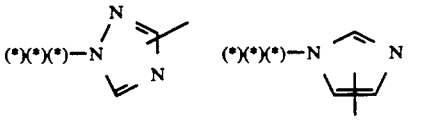
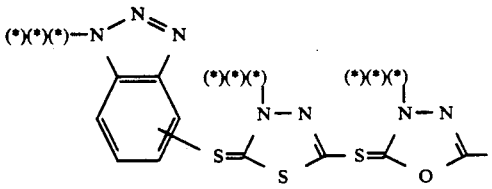
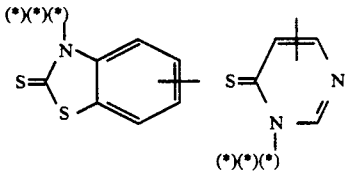
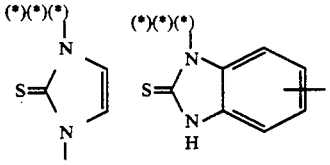
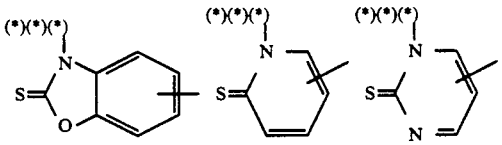
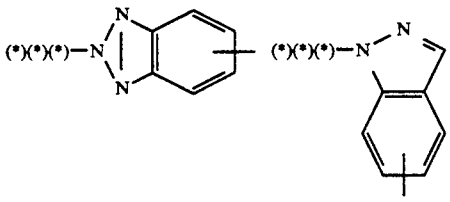
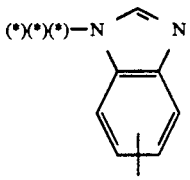
Examples of L2 include alkylene, alkenylene, arylene, divalent heterocyclic group, —O—, —S—, imino, COO—, —CONH—, —NHCONH—, —NHCOO—, —$SO_2NH$—, —CO—, —$SO_2$—, —SO—, —$NHSO_2NH$—, and combination thereof.

Specific preferred examples of A include reducing group (e.g., group containing a partial structure such as hydrazine, hydrazide, hydrazone, hydroxylamine, polyamine, enamine, hydroquinone, catechol, p-aminophenol, o-aminophenol, aldehyde or acetylene), group which can act on silver halide upon development to produce developable silver sulfide nulcei (e.g., group containing a partial structure such as thiourea, thioamide, thiocarbamate, dithiocarbamate, thiohydantoin or rhodanine), and quaternary salt (e.g., pyridinium salt).

Particularly useful among groups represented by A are those represented by the general formula [IV]:

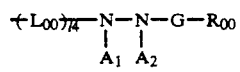

(IV)

wherein $A_1$ and $A_2$ each represents a hydrogen atom or one of $A_1$ and $A_2$ represents a hydrogen atom and the other represents a sulfinic residue or

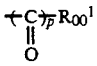

(in which $R^1_{00}$ represents an alkyl group, alkenyl group, aryl group, alkoxy group or aryloxy group, and p represents an integer 1 or 2); $R_{00}$ represents a hydrogen atom, alkyl group, aryl group, alkoxy group, aryloxy group, amino group, alkoxycarbonyl group, aryloxycarbonyl group, carbamoyl group, azo group or heterocyclic group; G represents a carbonyl group, sulfonyl group, sulfoxy group,

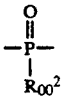

(in which $R^2_{00}$ represents an alkoxy group or aryloxy group) or iminomethylene group; $L_{00}$ represents an arylene group or divalent heterocyclic group; and $l_4$ represents an integer 0 or 1.

Specific examples of PUG represented by the general formula (III) will be set forth below. The symbol (*)(*)(*) indicates the position at which PUG is connected to —L—V—$_m$—Time—$_n$.

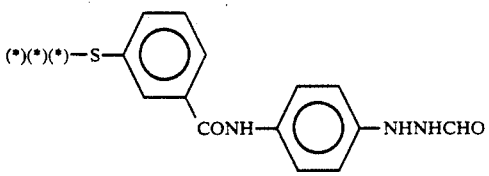

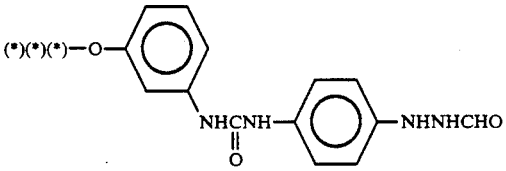

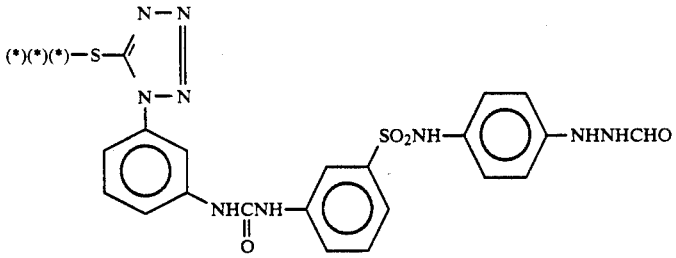

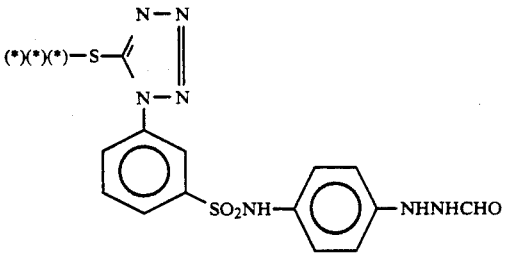

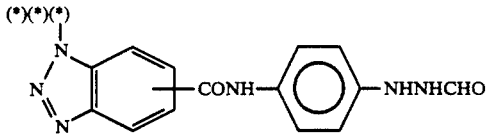

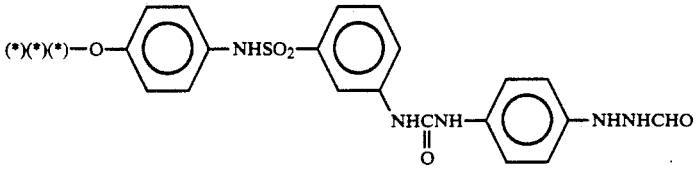

-continued
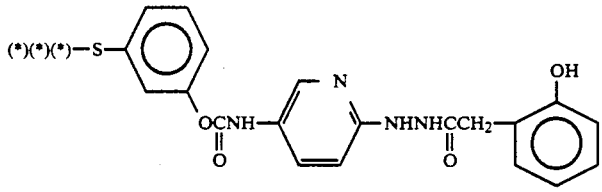
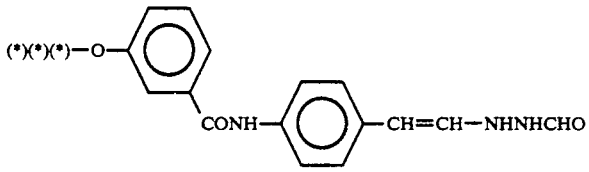
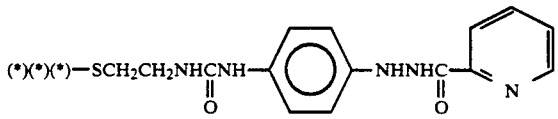
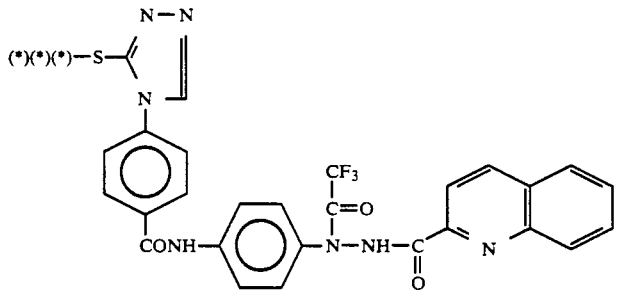
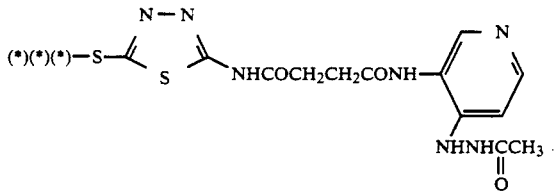
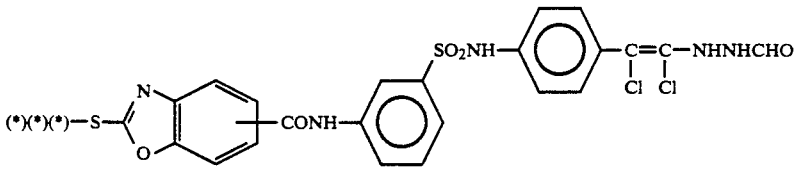
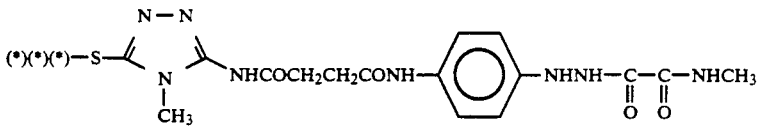
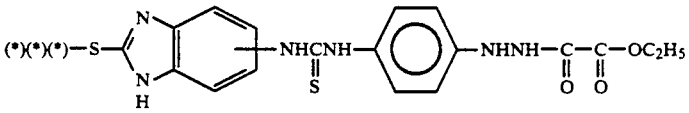

-continued
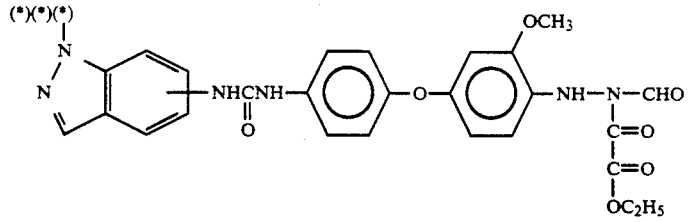
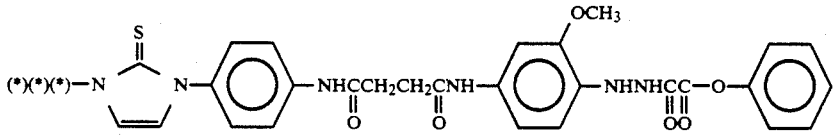
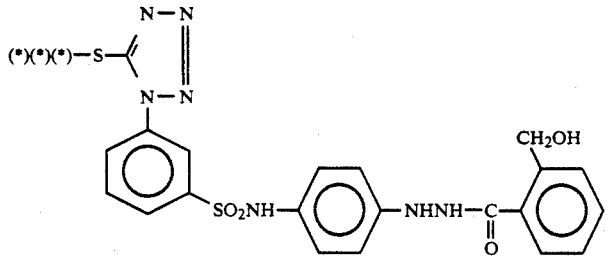
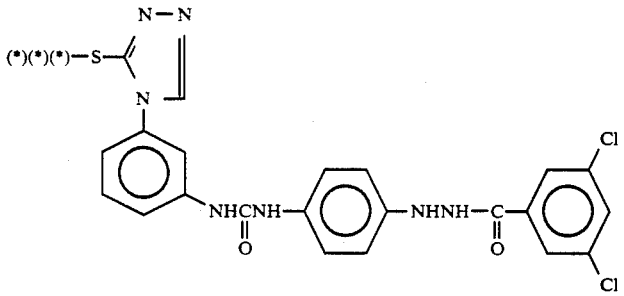
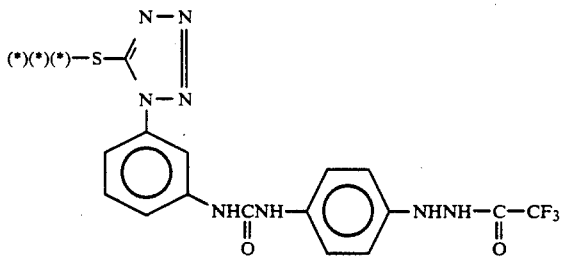
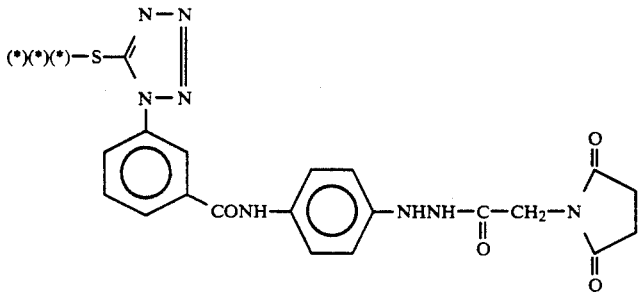

-continued

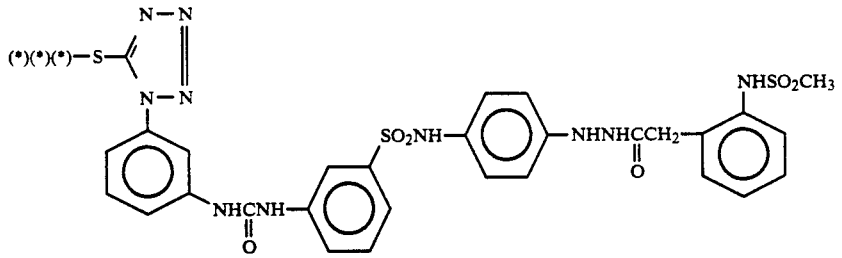

Other examples of the fogging agent represented by PUG include separatable groups to be released from couplers as disclosed in JP-A-59-170840.

Examples of the silver halide solvent represented by PUG include mesoionic compounds as disclosed in JP-A-60-163042, and U.S. Pat. Nos. 4,003,910, and 4,378,424, and mercaptoazoles or azolethiones as disclosed in JP-A-57-202531. Specific examples of such a silver halide solvent include those disclosed in JP-A-61-230135. With respect to other examples of such a silver halide solvent, reference can be made to JP-A-61-230135 and U.S. Pat. No. 4,248,962.

Examples of the bleach accelerator represented by PUG include compounds as disclosed in JP-A-61-201247, and Japanese Patent Application No. 62-248131.

Examples of the developing agent or auxiliary developing agent represented by PUG include hydroquinones, cathecols, aminophenols, p-phenylenediamines, pyrazolidones, and ascorbic acid.

Another example of PUG is a photographic reagent which additionally has a redox function of releasing the above mentioned photographic reagent upon the development reaction of silver halide. Useful examples of such a photographic reagent include coloring material for color diffusion transfer light-sensitive material, and DIR hydroquinones.

Other examples of PUG include those described in JP-A-61-230135, and U.S. Pat. No. 4,248,962.

Among these compounds represented by PUG in the present, preferred examples of those which can remarkably exhibit the effects of the present compound include fog inhibitor, development inhibitor, development accelerator, fogging agent, coupler, coupler-releasing coupler, diffusive dye, nondifusive dye, desilvering accelerator, desilvering inhibitor, silver halide solvent, competitive compound, developing agent, auxiliary developing agent, fixing accelerator, fixing inhibitor, image stabilizer, toner, processing dependency improver, dot improver, dye image stabilizer, photographic dye, surface active agent, film hardener, ultraviolet absorbent, fluorescent brightening agent, desensitizer, contrast improver, chelating agent, and DIR hydroquinone. Particularly preferred among these compounds are fog inhibitor, development inhibitor, development accelerator, fogging agent, desilvering accelerator, desilvering inhibitor, silver halide solvent, developing agent, auxiliary developing agent, fixing accelerator, fixing inhibitor, image stabilizer, toner, processing dependency improver, dot improver, dye image stabilizer, surface active agent, film hardener, desensitizer, contrast improver, chelating agent, and DIR hydroquinone.

Among the compounds represented by PUG in the present invention, preferred examples of those which can remarkably exhibit the effects of the present compound include fog inhibitor, development inhibitor, development accelerator, fogging agent, silver halide solvent, bleach accelerator, developing agent, auxiliary developing agent, and DIR hydroquinone. Particularly preferred among these compounds are fog inhibitor and development inhibitor.

In the general formulae (I) and (II), X represents an atomic group required to form a 5- or 6-membered ring with

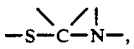

such as alkylene group, alkenylene group, and arylene group. Preferred examples of X will be set forth below.

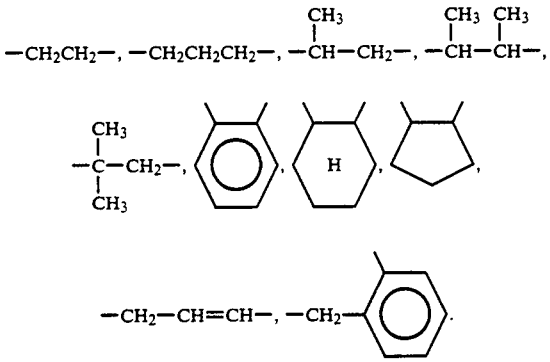

X may further contain substituents. Preferred examples of such substituents include those described with reference to $R^1$ and $R^2$.

The reaction of the compounds represented by the general formuale (I) and (II) during photographic processing will be further described hereinafter.

Most of silver contained in the silver halide photographic light-sensitive material is made soluble by a silver solvent such as sulfurous ion and thiosulfuric ion to flow out into the processing solution during development and subsequent processing steps (fixing and blix). During this process, a large amount of silver ions (I) or soluble silver complexes are produced in the light-sensitive material. It is believed that if a compound of the general formula (I) is present in the light-sensitive material, a reaction occurs as represented by the following Scheme 1 or 2 to release PUG. It is similarly believed that if a compound of the general formula (II) is present, a reaction occurs as represented by the following Scheme 3 to release PUG.

Scheme 1
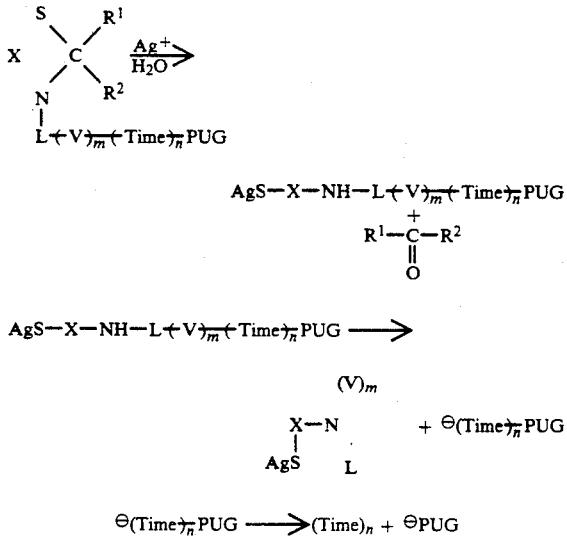
Scheme 2
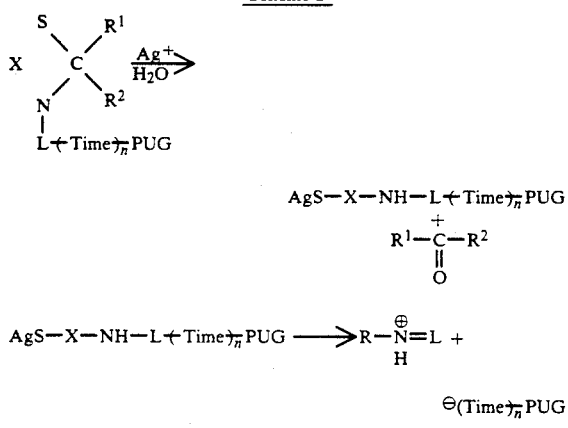
-continued
Scheme 2
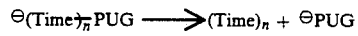
Scheme 3
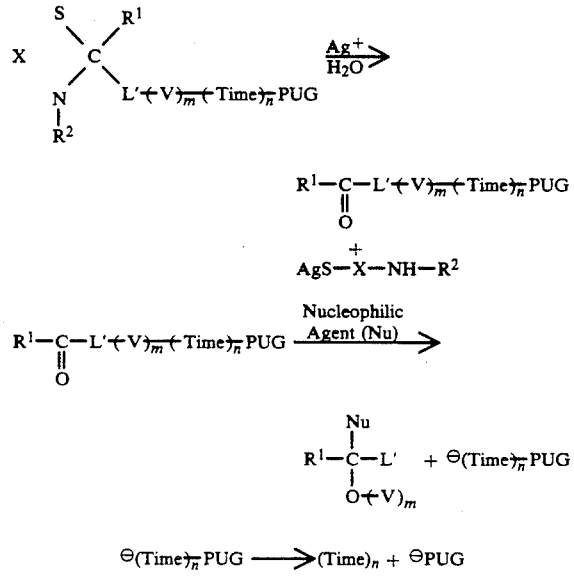
The nucleophilic agent in
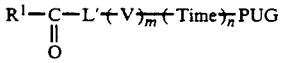
molecule may serve as a nucleophilic agent to trigger nucleophilic reaction.
Specific examples of the compound represented by the general formula (I) will be set forth below, but the present invention should not be construed as being limited thereto.
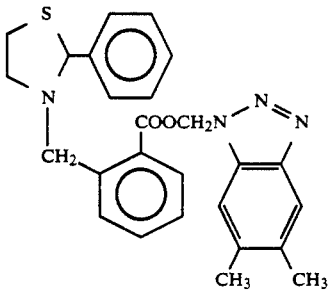
I-1.
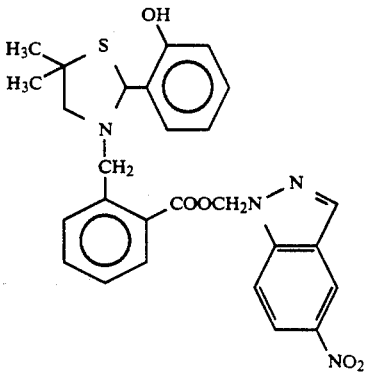
I-2.

-continued
I-3.
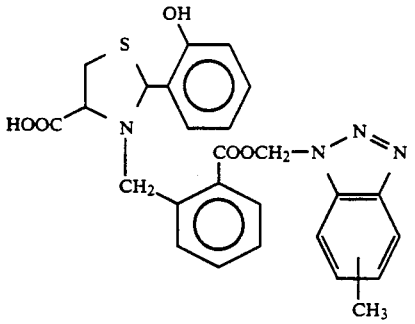
I-4.
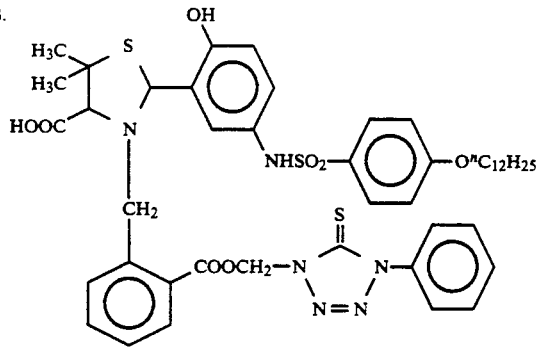
I-5.
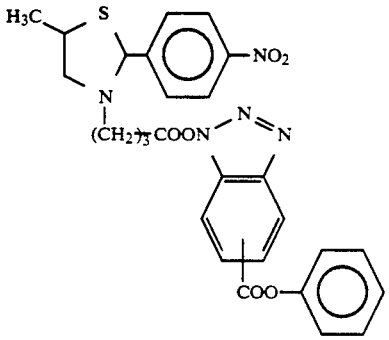
I-6.
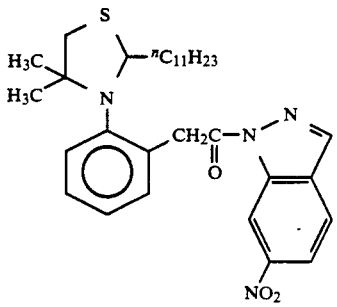
I-7.
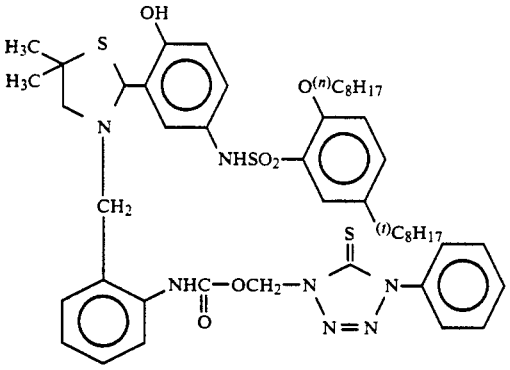
I-8.
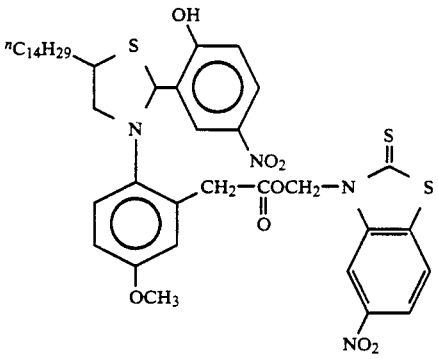
I-9.
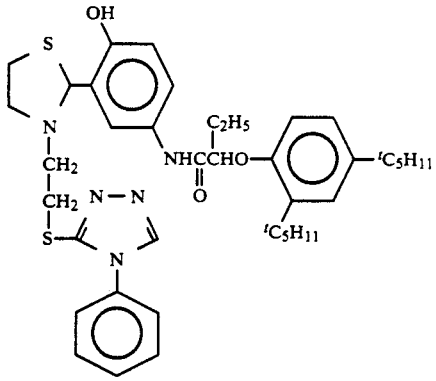

-continued
I-10.
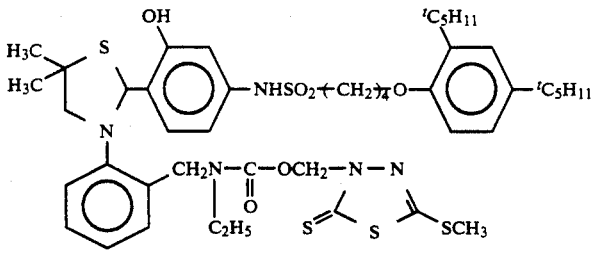
I-11.
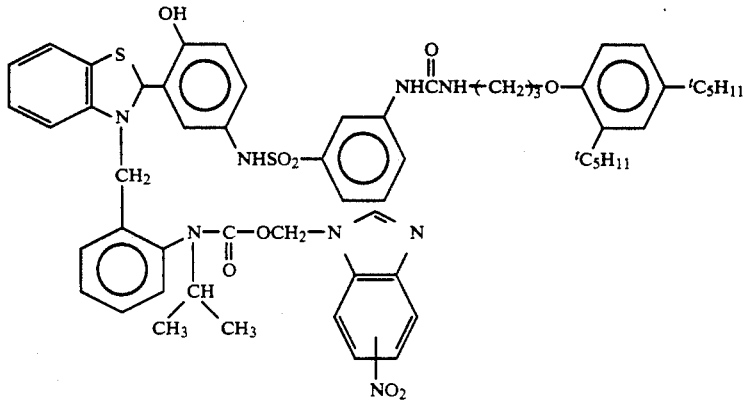
I-12.
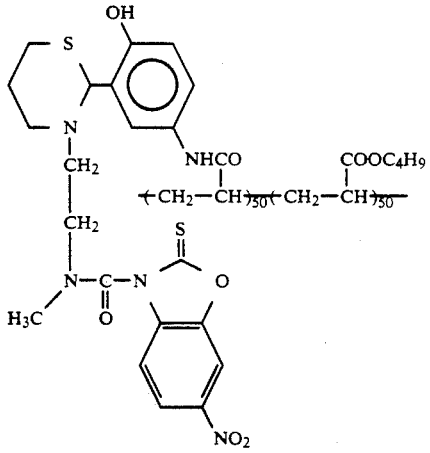
I-13.
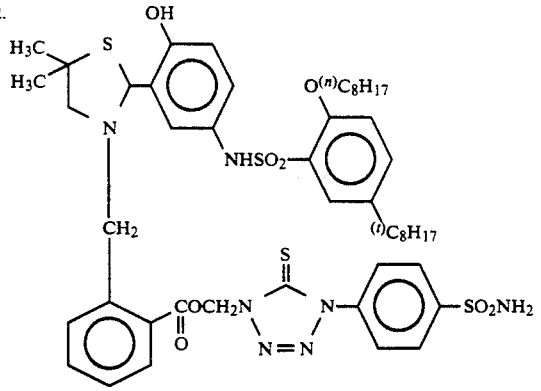
I-14.
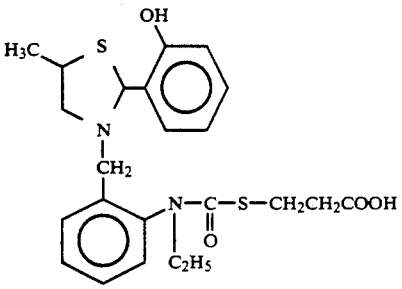
I-15.
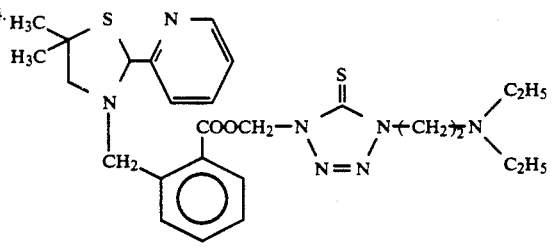

-continued
I-16.
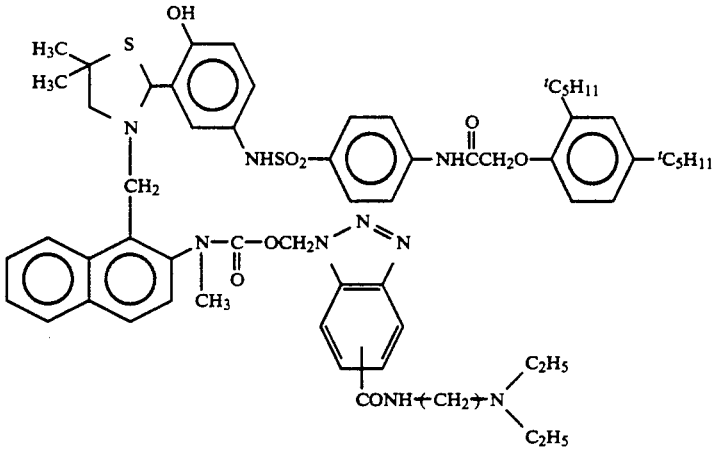
I-17.
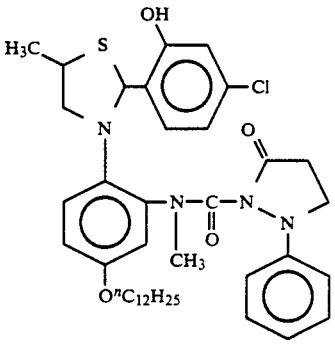
I-18.
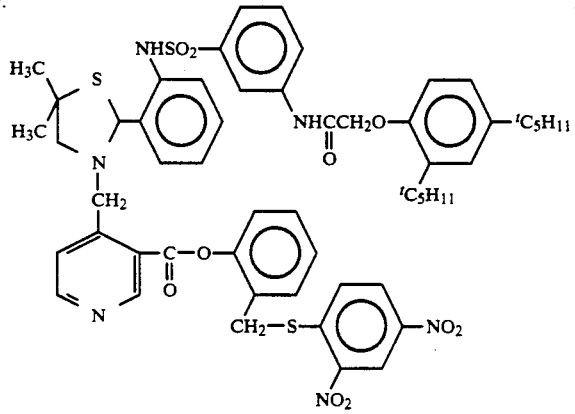
I-19.
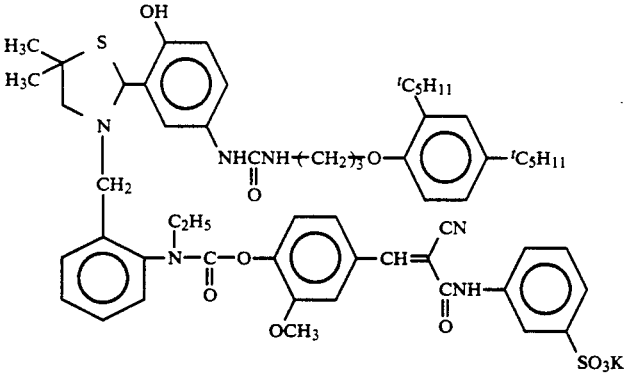
I-20.
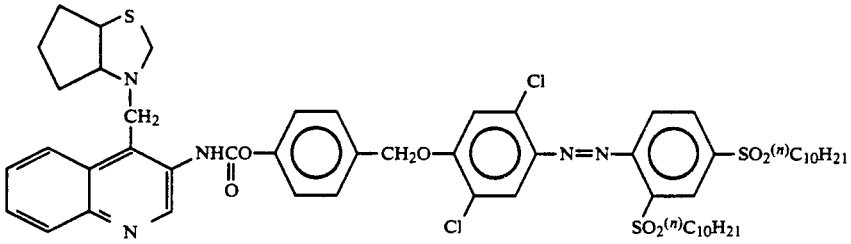

-continued
I-21.
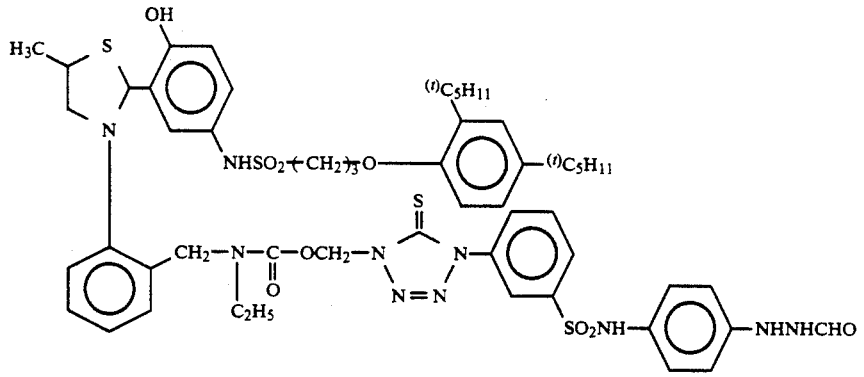
I-22.
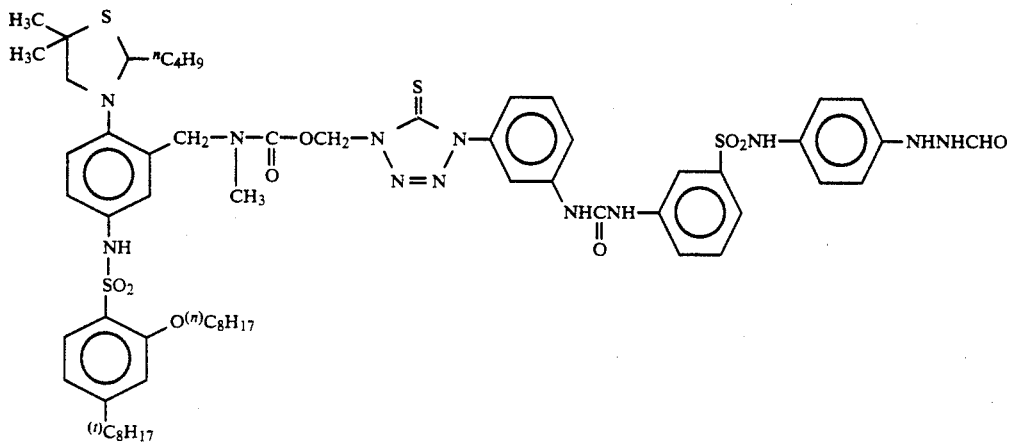
I-23.
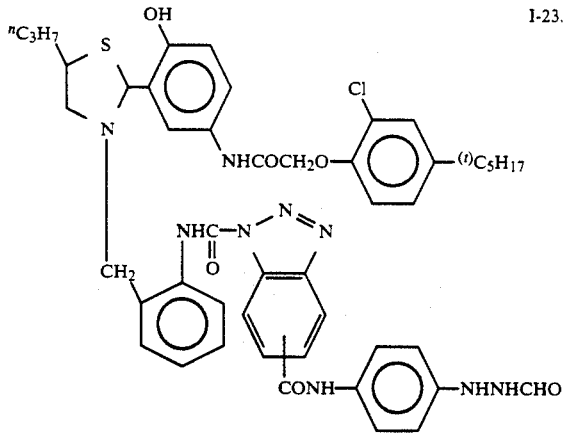
I-24.
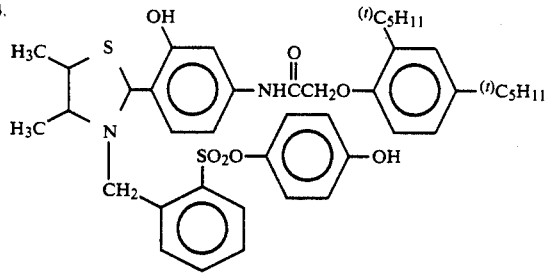
I-25.
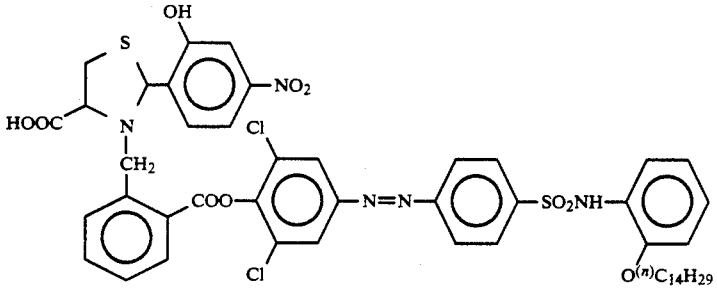

-continued
I-26.
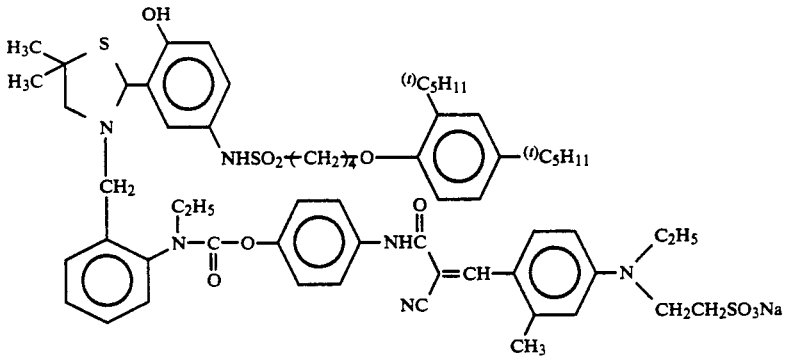
I-27.
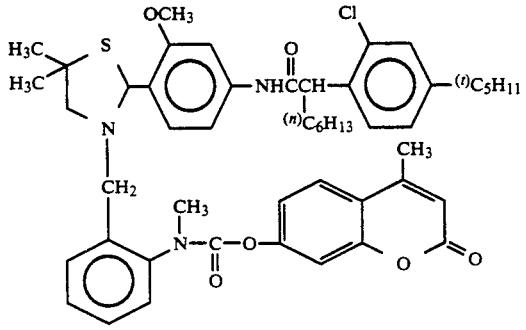
I-28.
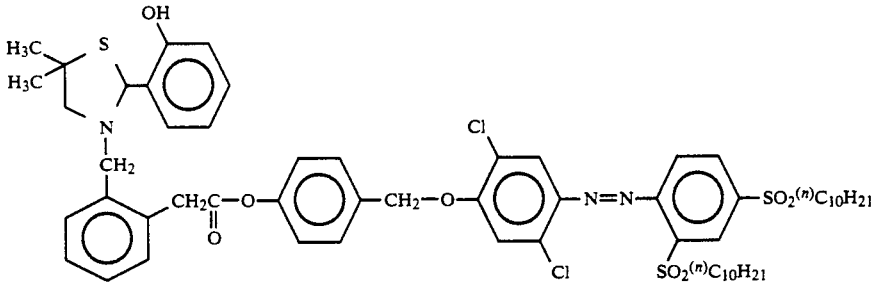
I-29.
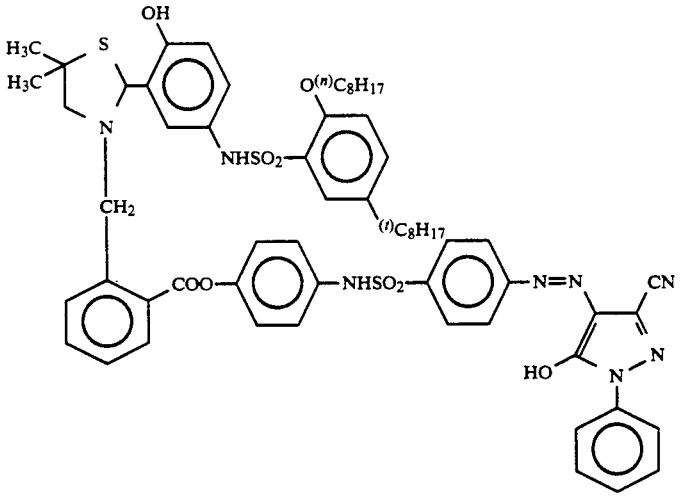

-continued
I-30.
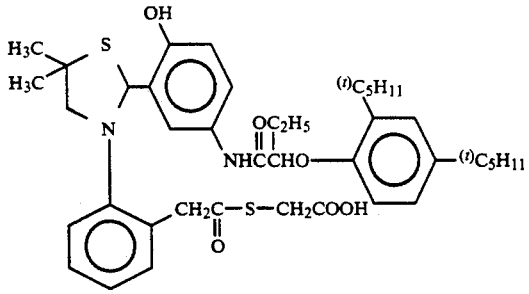
I-31.
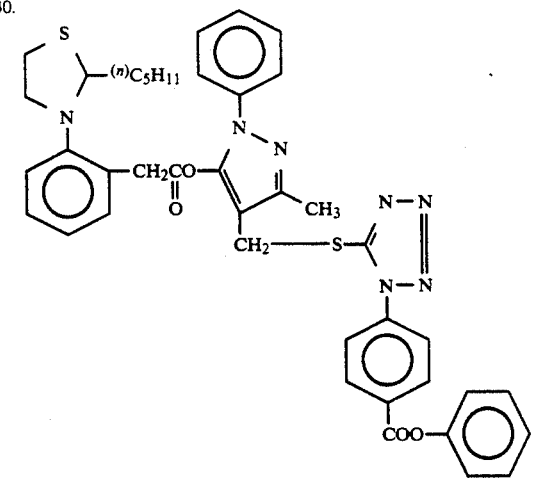
I-32.
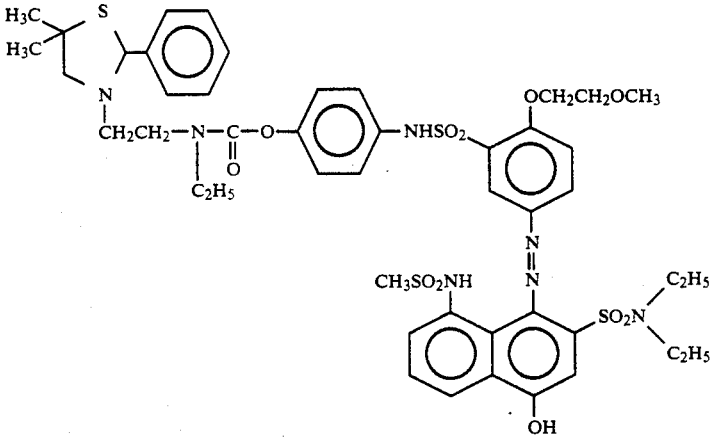
I-33.
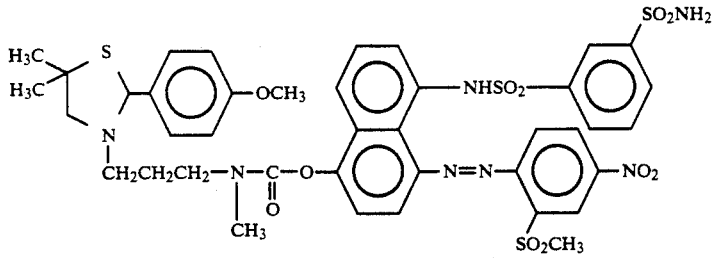
I-34.
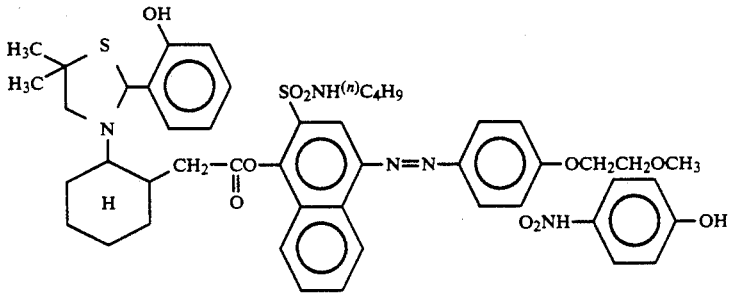

-continued
I-35.
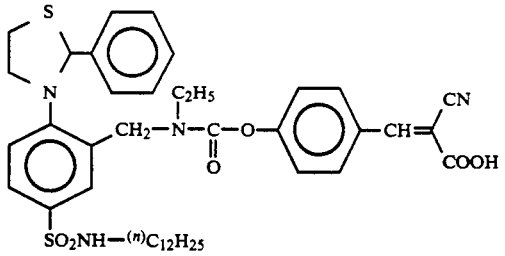
I-36.
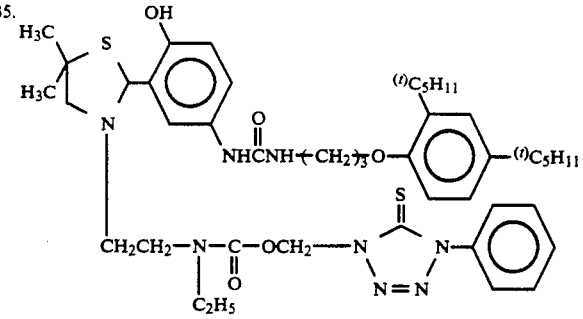
I-37.
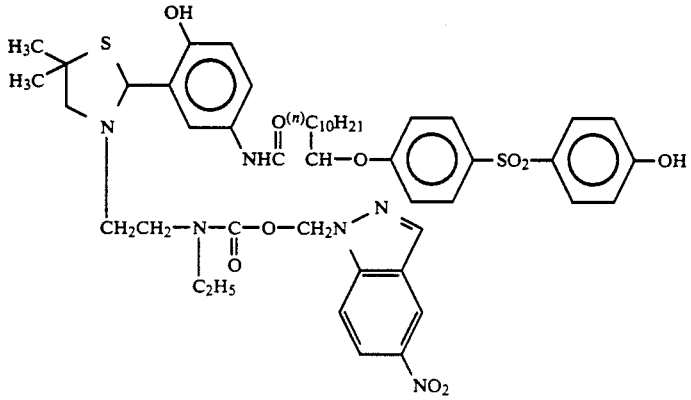
I-38.
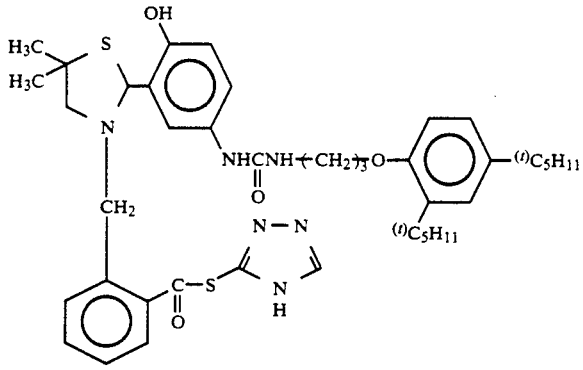
I-39.
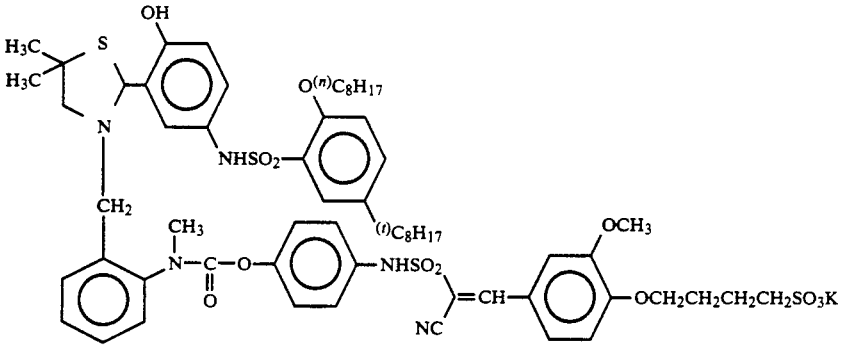

-continued

I-40.

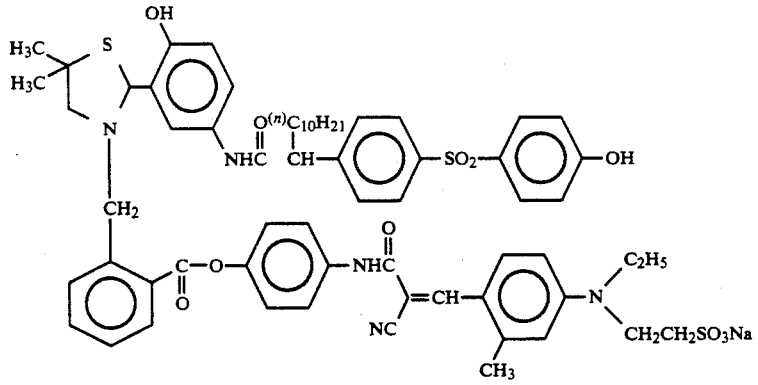

I-41.

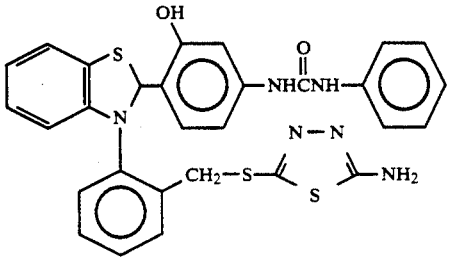

I-42.

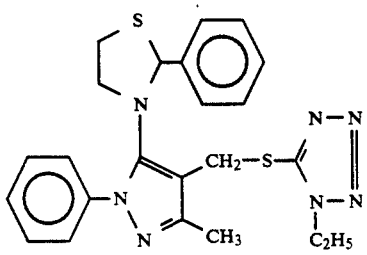

I-43.

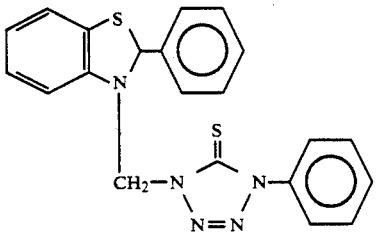

I-44.

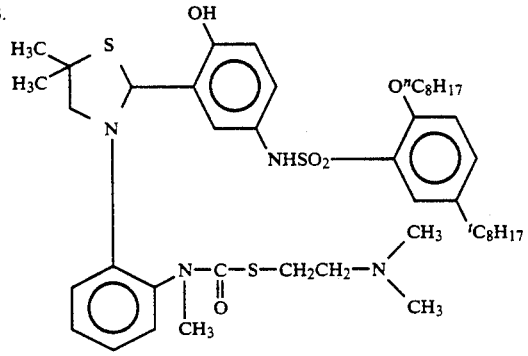

Specific examples of synthesis of the compound of the present invention will be set forth below.

SYNTHESIS EXAMPLE I-1

Synthesis of Compound I-1

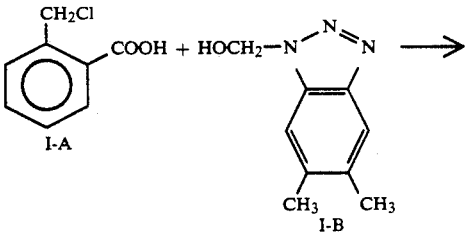

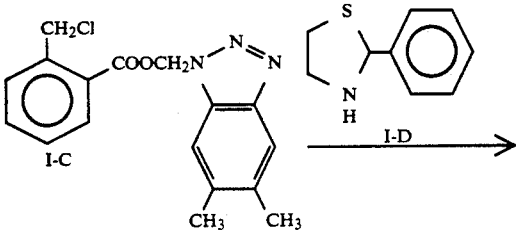

-continued

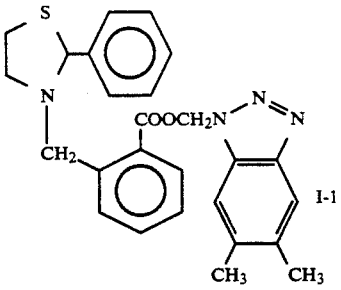

I-1

1-(1): Synthesis of Compound 1-C 12.1 g (70.8 mmol) of Compound 1-A, 16.5 g (93.1 mmol) of Compound 1-B and 0.3 g (2.46 mmol) of 4-dimethylaminopyridine were dissolved in 150 ml of acetone. The solution was stirred while being cooled with ice. A solution of 20.4 g (99.0 mmol) of dicyclohexylcarbodiimide in 100 ml of acetone was added dropwise to the solution. After the dropwise addition was completed, the solution was allowed to cool to room temperature where it was further stirred for 3 hours. The resulting solid matter was removed by filtration. The filtrate was concentrated under reduced pressure, and then purified through a silica gel column chromatography (developing solvent: 1:1 (volume) mixture of n-hexane and ethyl acetate) to obtain 8.17 g (24.8 mmol) of the desired compound 1-C in the form of colorless viscous oily matter. (Yield: 35%)

1-(2): Synthesis of Compound I-1

1.82 g (11.0 mmol) of Compound 1-D, 1.65 g (5.00 mmol) of Compound 1-C and sodium iodide in the catalytic amount were dissolved in 8 ml of dimethylformamide. After the solution was stirred at room temperature for 12 hours, the reaction solution was then purified through a silica gel column chromatography (developing solvent: 20:1 (volume) mixture of chloroform and ethyl acetate) to obtain 1.35 g (2.94 mmol) of the desired Compound I-1 in the form of colorless viscous oily matter. (Yield: 56%)

The chemical structure of the product was confirmed by $^1$H-NMR spectrum and mass spectrum.

Elementary analysis: Calculated %: C68.10, H5.71, N12.22, S6.99. Found %: C68.01, H5.65, N12.28, S6.79.

Rf value: 0.55 (Silica gel TLC Art. 5735 available from Merc Co., Developing solvent: 20:1 (volume) mixture of chloroform and ethyl acetate)

SYNTHESIS EXAMPLE I-2

Synthesis of Compound I-43

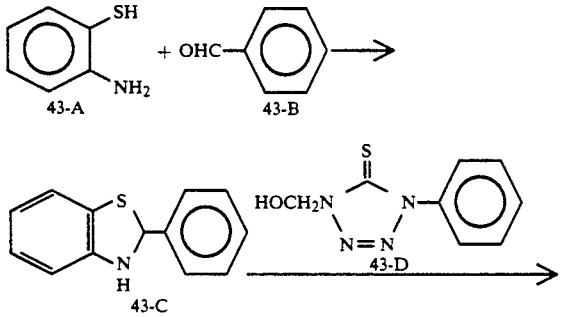

-continued

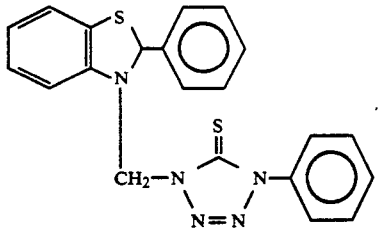

2-(1) Synthesis of Compound 43-C 125 g (1.00 mol) of o-aminothiophenol was dissolved in 200 ml of ethanol. 106 g (1.00 mol) of benzaldehyde was added dropwise to the solution with stirring at room temperature. After 1 hour, the resulting crystal was filtered off, and then recrystallized from ethanol to obtain 97.0 g (0.455 mol) of a white solid. (Yield: 46%)

2-(2) Synthesis of Compound I-43

2.13 g (10.0 mmol) of Compound 43-C and 2.08 g (10.0 mmol) of Compound 43-D were dissolved in 20 ml of ethanol. The solution was stirred at room temperature for 1 hour, the reaction solution was then concentrated under reduced pressure. The concentrate was then recrystallized from a mixture of ethyl acetate and n-hexane to obtain 1.3 g (3.22 mmol) of a white solid. (Yield: 32%)

The chemical structure of the product was confirmed by $^1$H-NMR spectrum and mass spectrum. (m.p. 113°-114° C.)

Elementary analysis: Calculated %: C62.51, H4.25, N17.36, S15.89. Found %: C62.4, H4.26, N17.31, S16.01.

Rf value: 0.80 (Silica gel TLC Art. 5735 available from Merc Co., Developing solvent: 1:1 (volume) mixture of ethyl acetate and n-hexane)

Specific examples of the compound represented by the general formula (II) will be set forth below, but the present invention should not be construed as being limited thereto.

II-1.

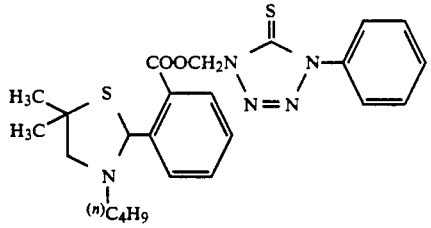

II-2.

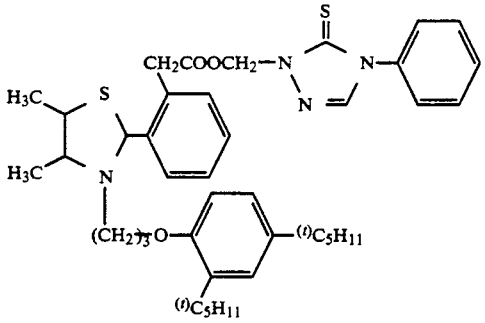

II-3.

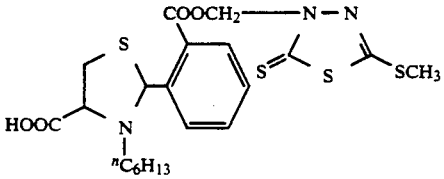

II-4.

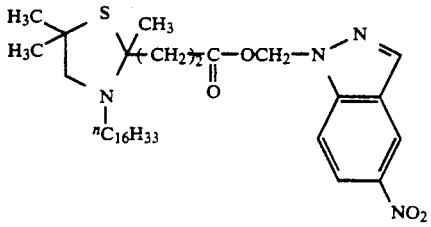

-continued
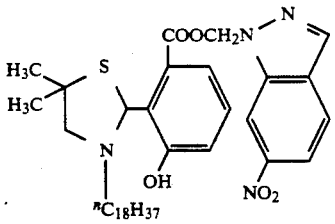
II-5.
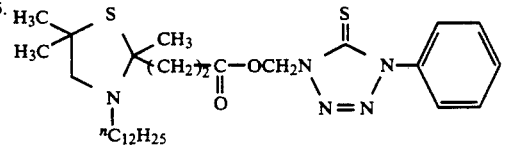
II-6.
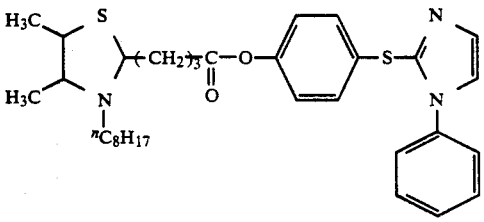
II-7.
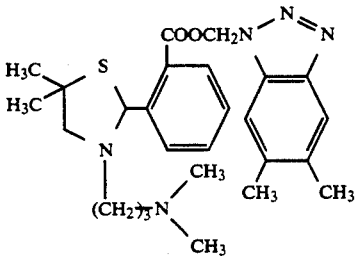
II-8.
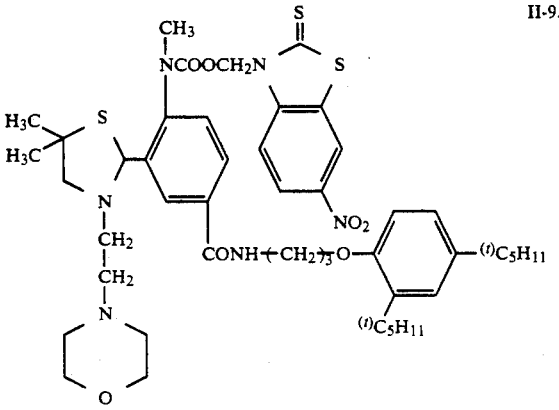
II-9.
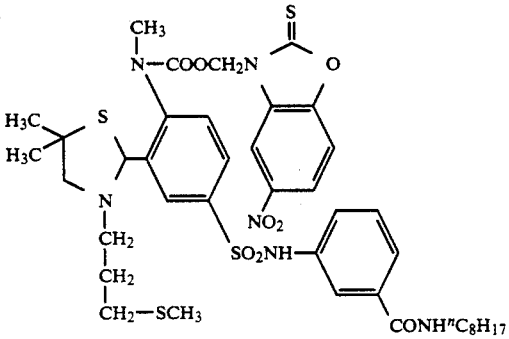
II-10.
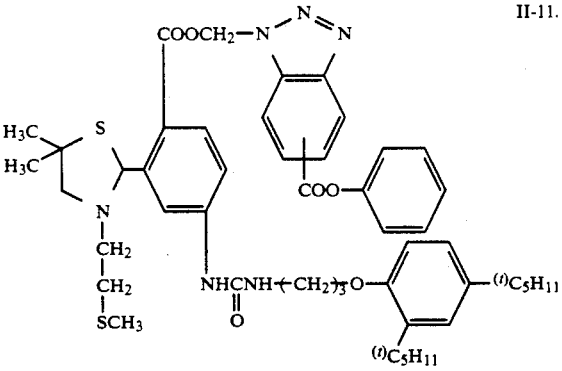
II-11.
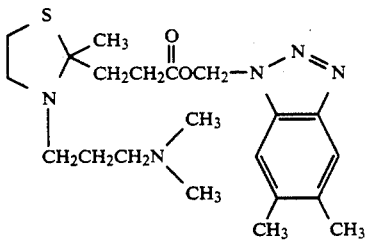
II-12.
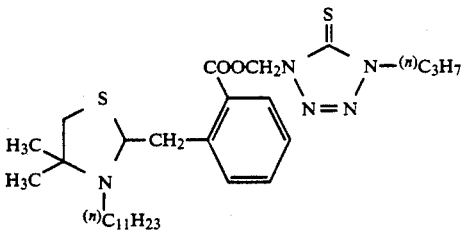
II-13.
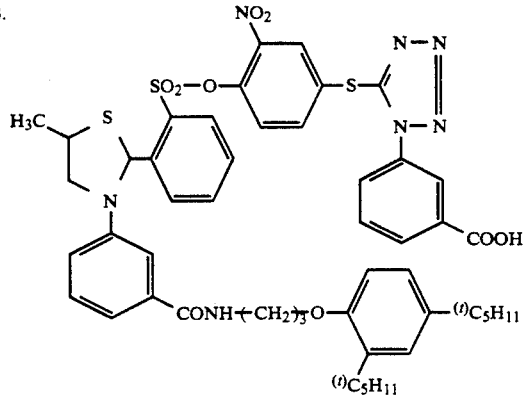
II-14.

-continued
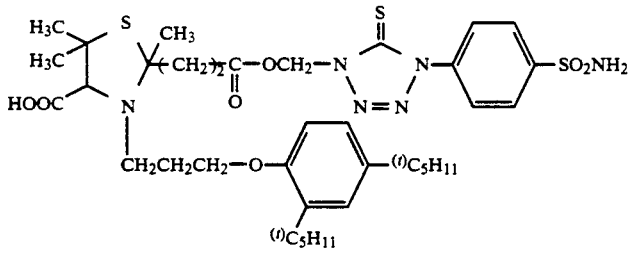
II-15.
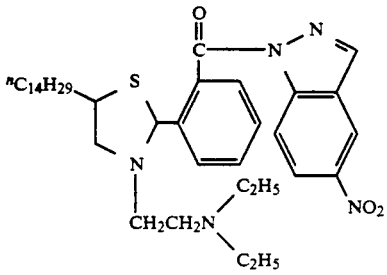
II-16.
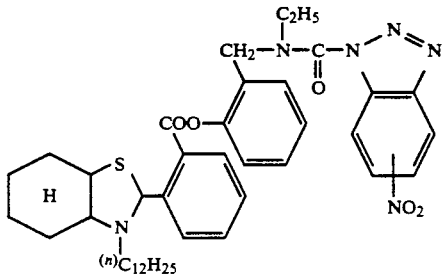
II-17.
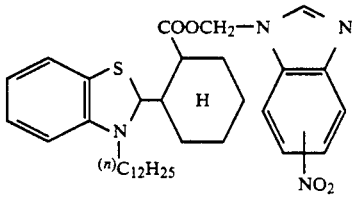
II-18.
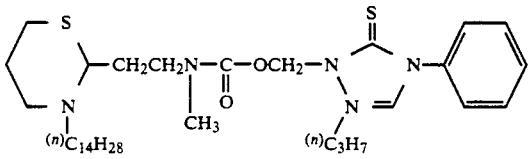
II-19.
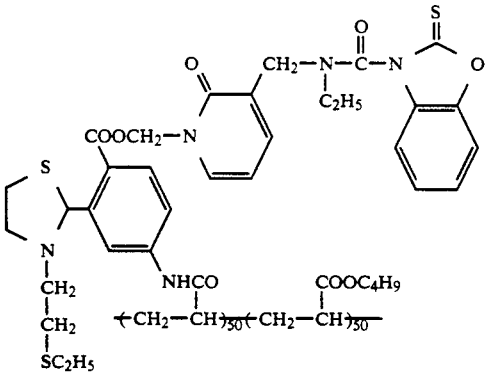
II-20.
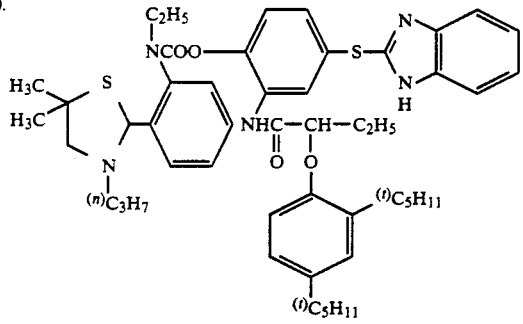
II-21.
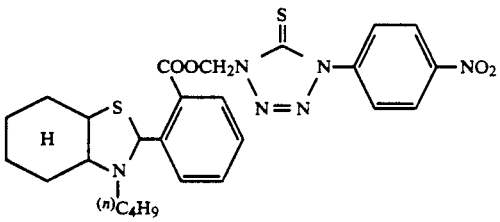
II-22.
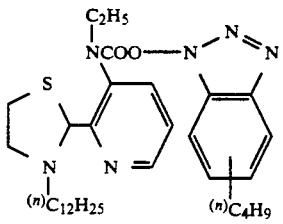
II-23.

-continued
II-24.
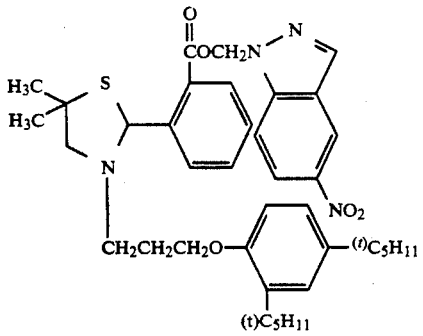
II-25.
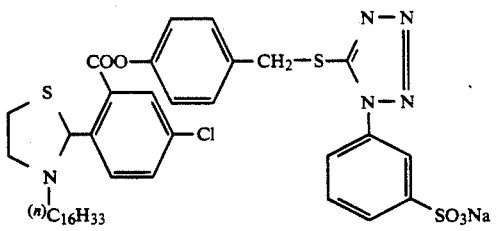
II-26.
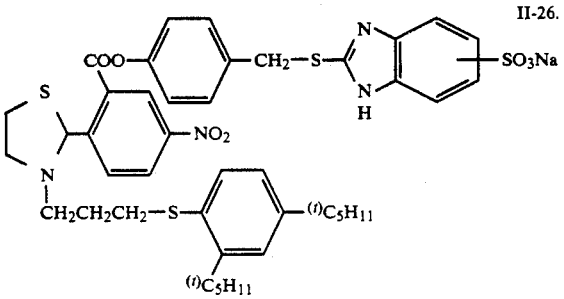
II-27.
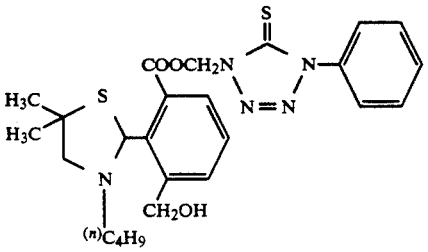
II-28.
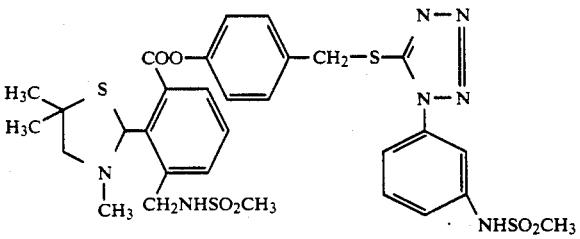
II-29.
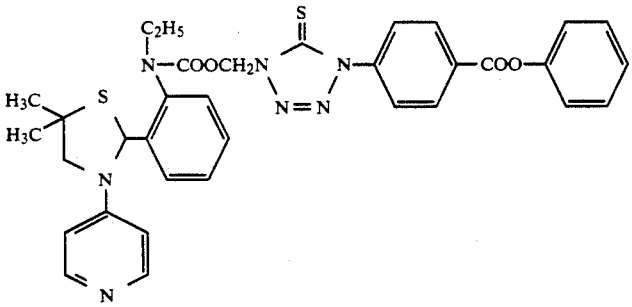
II-30.
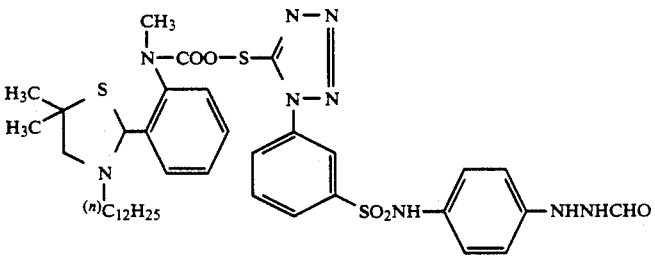

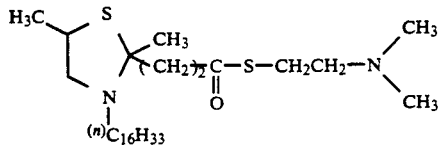

-continued

II-31.

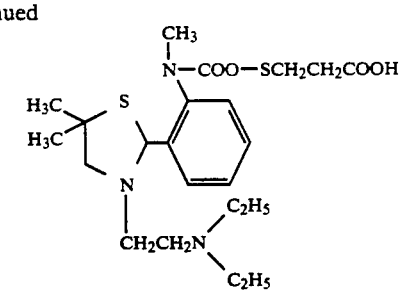

II-32.

Specific examples of the synthesis of the compound of the present invention will be set forth below.

SYNTHESIS EXAMPLE II-1

Synthesis of Compound II-8

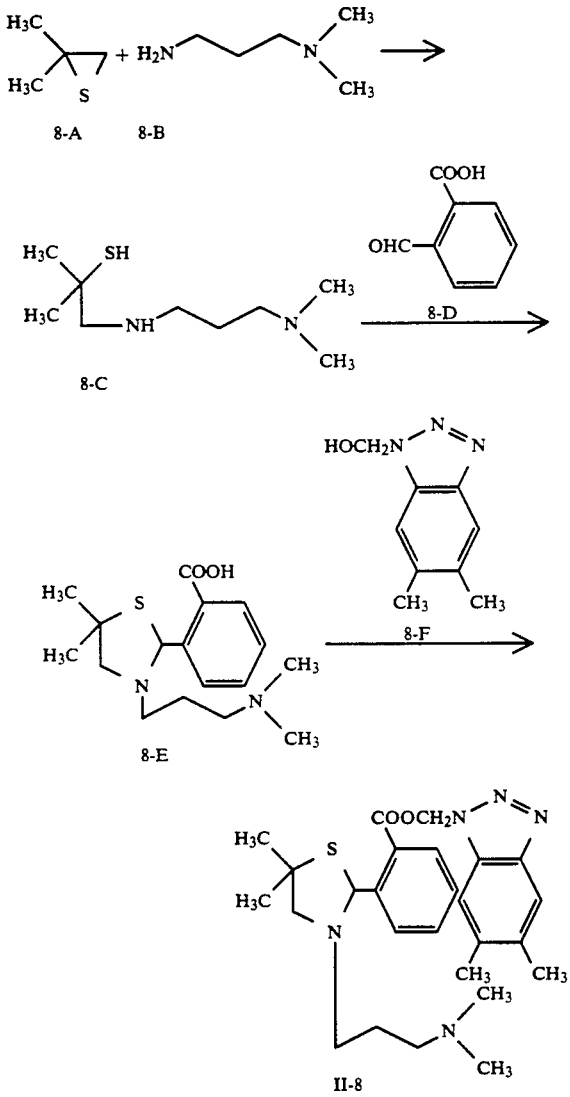

1-(1) Synthesis of Compound 8-C 61.2 g (0.60 mol) of Compound 8-B was dissolved in 100 ml of benzene. The solution was then heated under reflux so that it was dehydrated. A solution of 8.82 g (0.10 mol) of Compound 8-A in 50 ml of benzene was gradually added dropwise to the reaction system while the latter was heated under reflux. After the dropwise addition was completed, the reaction system was refluxed for 4 hours. The reaction solution was then concentrated under reduced pressure (about 20 mmHg). The concentrate was further subjected to fractional distillation (distillate from 86° to 87° C./mmHg) to obtain 8.0 g (42.1 mmol) of a colorless transparent liquid (8-C). (Yield: 42%)

1-(2) Synthesis of Compound II-8-E 4.00 g (21.0 mol) of Compound 8-C and 3.00 g (20.0 mmol) of Compound 8-D were dissolved in 30 ml of methanol. The solution was stirred at room temperature for 1 hour. The reaction solution was further allowed to undergo reaction at a temperature of 40° C. for 4 hours. After the reaction solution was concentrated, the resulting concentrate was then purified through a silica gel column chromatography (developing solvent: 1:3 (volume) mixture of methanol and chloroform) to obtain 5.90 g (18.3 mmol) of Compound 8-E. (Yield: 92%)

1-(3) Synthesis of Compound II-8

3.22 g (10.0 mmol) of Compound 8-E, 1.80 g (10.2 mmol) of Compound 8-F and 0.1 g (0.82 mmol) of 4-dimethylaminopyridine were dissolved in 20 ml of acetone. A solution o f 4.12 g (20.0 mmol) o f dicyclohexylcarbodiimide in 10 ml of acetone was added dropwise to the solution with stirring while being cooled with ice. After the dropwise addition was completed, the reaction system was heated to room temperature where it was further stirred for 5 hours. The resulting crystalline solid was removed by filtration. The filtrate was concentrated and purified through a silica gel chromatography (developing solvent: 1:5 mixture (volume) of methanol and chloroform) to obtain 3.9 g (8.10 mmol) of a colorless transparent viscous liquid II-8. (Yield: 81%)

The chemical structure of the product was confirmed by $^1$H-NMR spectrum and mass spectrum.

Elementary analysis: Calculated %: C64.83, H7.32, N14.54, S6.66. Found %: C64.65, H7.26 N14.46, S6.74.

Rf value: 0.36 (Silica gel TLC Art. 5735 available from Merc Co., Developing solvent: 1:9 (volume) mixture of methanol and chloroform)

SYNTHESIS EXAMPLE II-2

Synthesis of Compound II-12

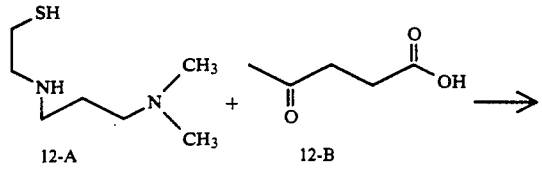

-continued

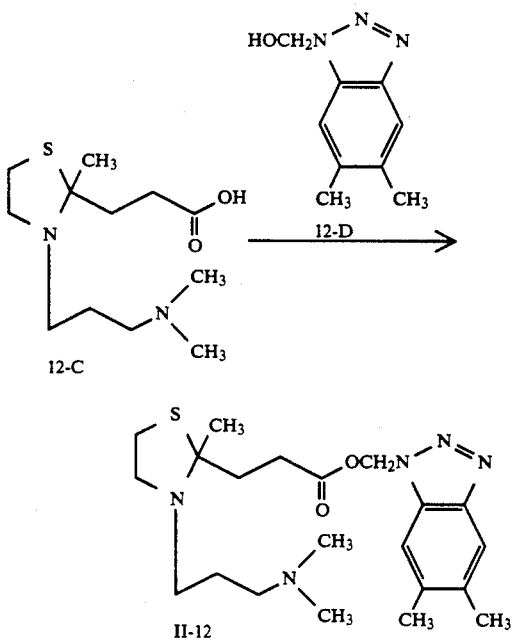

2-(1) Synthesis of Compound 12-C 3.20 g (19.8 mmol) of 12-A and 2.32 g (20.0 mmol) of 12-B were dissolved in 30 ml of methanol. The solution was then stirred at room temperature for 12 hours. The reaction solution was concentrated. The concentrate was then purified through a silica gel column chromatography (developing solvent: 1:1 mixture (volume) of methanol and chloroform) to obtain 4.90 g (18.8 mmol) of Compound 12-C. (Yield: 95%)

2-(2) Synthesis of Compound II-12

4.90 g (18.8 mol) of Compound 12-C, 3.8 g (21.5 mmol) of 12-D and 0.3 g (2.46 mmol) of 4-dimethylaminopyridine were dissolved in 50 ml of acetone. A solution of 6.209 (30.1 mmol) of dicyclohexylcarbodiimide in 30 ml of acetone was added dropwise to the solution with stirring while being cooled with ice. After the dropwise addition was completed, the reaction system was heated to room temperature where it was further stirred for 1 hour. The resulting crystalline solid was removed by filtration. The filtrate was concentrated and purified through a silica gel chromatography (developing solvent: 1:9 mixture (volume) of methanol and chloroform) to obtain 3.87 g (9.22 mmol) of a colorless transparent viscous liquid II-12. (Yield: 49%)

The chemical structure of the product was confirmed by $^1$H-NMR spectrum and mass spectrum.

Elementary analysis: Calculated %: C60.11, H7.93, N16.69, S7.64. Found %: C60.26, H7.99, N16.62, S7.44.

Rf value: 0.52 (Silica gel TLC Art. 5735 available from Merc Co., Developing solvent: 1:5 (volume) mixture of methanol and chloroform)

The present compounds of the general formulae (I) and (II) can be incorporated in a hydrophilic colloidal layer provided either above or under a silver halide emulsion layer or in both the hydrophilic colloidal layers to accomplish the desired objects If the present compounds are used, it is required to select a suitable separatable group PUG needs depending on each purpose. The amount of PUG to be incorporated depends on the type of photographic light-sensitive material or the properties of PUG selected. Those skilled in the art can easily select a proper amount of PUG depending on the type of photographically useful reagent. Typical photographically useful reagents will be described hereinafter.

For example, if PUG is a fog inhibitor or development inhibitor, the present compound is preferably used in an amount of $1\times10^{-2}$ to $1\times10^{-1}$ mol, particularly $1\times10^{-6}$ to $5\times10^{-2}$ mol per mol of silver halide. If PUG is a development accelerator or fogging agent, the present compound is preferably used in the same amount as in the development inhibitor. If PUG is a dye to be used for the formation of images, the present compound is preferably used in an amount of $1\times10^{-3}$ to $1\times10$ mol, particularly $1\times10^{-2}$ to 4 mol per mol of silver halide.

The incorporation of materials in the silver halide emulsion layer and/or other hydrophilic colloid layers can be accomplished by commonly used methods. In other words, water-soluble compounds may be incorporated in water or an aqueous solution of gelatin in the form of aqueous solution. Compounds insoluble or difficultly soluble in water may be mixed with an aqueous solution of gelatin in the form of solution in a solvent compatible with water or may be incorporated in these layers by methods as described in U.S. Pat. No. 2,322,027. For example, compounds insoluble or difficultly soluble in water may be dispersed in a hydrophilic colloid in the form of a solution in phthalic alkylester (e.g., dibutyl phthalate, dioctyl phthalate), ester phosphate (e.g., diphenyl phosphate, triphenyl phosphate, tricresyl phosphate, dioctyl butyl phosphate), ester citrate (e.g., tributyl acetylcitrate), ester benzoate (e.g., octyl benzoate), alkylamide (e.g., diethyllaurylamide), ester aliphate (e.g., dibutoxyethyl succinate, diethyl azerate), ester trimesate (e.g., tributyl trimesate), or an organic solvent having a boiling point of about 30 to 150° C. such as lower alkyl acetate (e.g., ethyl acetate, butyl acetate), ethyl propionate, secondary butyl alcohol, methyl isobutyl ketone, $\beta$-ethoxyethyl acetate, and methylcellosolve acetate. These high boiling organic solvents and low boiling organic solvens may be used in admixture.

The light-sensitive material of the present invention can be applied to e.g., coupler system color photographic light-sensitive materials. Examples of such color light-sensitive materials include color negative films for photographing (e.g., general purpose, professional use, motion picture), color reversal films, color photographic papers, color reversal photographic papers, and cinema positive films.

The compound of the present invention can also be used in a photographic system using a silver dye bleach process as disclosed in "The Theory of the Photographic Process", Chapter 12, Principles and Chemistry of Color Photography IV. Silver Dye Bleach Process, 4th ed., T. H. James ed., Macmillan, New York, 1977, pp. 363-366.

The present invention can also be used in a black-and-white light-sensitive material. Examples of such a black-and-white light-sensitive material include direct X-ray films for medical use, black-and-white films for general photographing, lithographic films, and scanner films.

When applied to the color dispersion transfer process, the present light-sensitive material can be in the form of peel apart type light-sensitive material, integrated type light-sensitive material as disclosed in JP-B-46-16356 and JP-B-48-33697, JP-A-50-13040, and British Patent 1,330,524, or nonpeeling type film unit as disclosed in JP-A-57-119345.

The present invention can also be applied to heat-developable light-sensitive material as disclosed in U.S. Pat. No. 4,500,626, and JP-A-60-133449, JP-A-59-218443, and JP-A-61-238056.

Preferred examples of the light-sensitive material in which the effects of the present compound can be remarkably attained include black-and-white light-sensitive material.

The silver halide to be used in the present invention may be any of silver chloride, silver bromide, silver iodide, silver chlorobromide, silver chloroiodide, silver iodobromide or silver chloroiodobromide. The silver halide grains may have a uniform halogen composition or may have a multiple structure wherein the halogen composition differs from surface to internal portion (as disclosed in JP-A-57-154232, JP-A-58-108533, JP-A-59-48755, and JP-A-59-52237, U.S. Pat. No. 4,433,048, and European Patent 100,984). Tabular silver halide grains having a thickness of 0.5 μm or less, a diameter of at least 0.6 μm and an average aspect ratio of 5 or more (as disclosed in U.S. Pat. Nos. 4,414,310 and 4,435,499, and West German Patent Disclosure (OLS) 3,241,646A1) or monodisperse emulsions having a nearly uniform grain size distribution (as disclosed in JP-A-57-178235, JP-A-58-100846, and JP-A-58-14829, International Patent Disclosure No. 83/02338A1, and European Patents 64,412A3 and 83,377A1) can be used in the present invention. Two or more silver halide grains having different crystal habits, halogen compositions, grain sizes and grain size distributions can be used in combination. Two or more monodisperse emulsions having different grain sizes can be used in admixture to control gradation.

The silver halide grains to be used in the present invention preferably have an average grain size of 0.001 to 10 μm, more preferably 0.001 to 5 μm. These emulsions can be prepared by any of the acid process, the neutral process, the ammonia process, etc. The reaction of soluble silver salts and soluble halides can be carried out by any of a single jet process, a double jet process, a combination thereof. A method in which grains are formed in the presence of excess silver ions (so-called reverse mixing method) may be used. Further, a so-called controlled double jet process, in which a pAg value of a liquid phase in which silver halide grains are formed is maintained constant, may also be used. In order to expedite the growth of silver halide grains, the rate at which silver salts and halogen grains are added may be raised (as disclosed in JP-A-55-142329 and JP-A-55-158124, and U.S. Pat. No. 3,650,757).

Further, epitaxial junction type silver halide grains can be used (as disclosed in JP-A-56-16124, and U.S. Pat. No. 4,094,684.

In the step of forming silver halide grains to be used in the present invention, as a silver halide solvent there can be used ammonia, an organic thioether derivative as disclosed in JP-B-47-11386, or a sulfur-containing compound as disclosed in JP-A-53-144319.

During silver halide grain formation or physical ripening, a cadmium salt, a zinc salt, a lead salt, or a thallium salt may be present in the system.

In order to improve high intensity reciprocity law failure and low intensity reciprocity law failure, a water-soluble iridium salt such as iridium chloride (III, IV) and ammonium hexachloroiridiumate or a water-soluble rhodium salt such as rhodium chloride can be used.

Soluble salts may be removed from the silver halide emulsion which has been subjected to precipitation or physical ripening. To this end, noodle rinse process or sedimentation process can be employed.

The silver halide emulsion may be used unripened but normally is used after being subjected to chemical sensitization. Sulfur sensitization process, reduction sensitization process and noble metal sensitization process can be used singly or in combination as known in the art of emulsion for ordinary light-sensitive materials. Such a chemical sensitization process can be effected in the presence of a nitrogen-containing heterocyclic compound (as disclosed in JP-A-58-126526 and JP-A-58-215644).

The silver halide grains also may be of the type which forms latent images mainly on the surface thereof or the type which forms latent images mainly inside thereof. A direct reversal emulsion comprising a combination of an internal latent image type emulsion and a nucleating agent can be used. Examples of an internal latent image type emulsion suitable for this purpose are disclosed in U.S. Pat. Nos. 2,592,250 and 3,761,276, JP-B-58-3534, and JP-A-57-136641.

The photographic emulsion to be used in the present invention may be subjected to spectral sensitization with a methine dye or the like. Examples of such a dye include cyanine dye, melocyanine dye, composite cyanine dye, composite melocyanine dye, holopolar cyanine dye, hemicyanine dye, styryl dye and hemioxonol dye. Particularly preferred among these dyes are cyanine dye, melocyanine dye and composite melocyanine dye. Any of nucleus which are commonly used as basic heterocyclic nucleus for cyanine dye can be applied to these dyes. Examples of suitable nucleus which can be applied to these dyes include pyrroline nucleus, oxazoline nucleus, thiazoline nucleus, pyrrole nucleus, oxazole nucleus, thiazole nucleus, selenazole nucleus, imidazole nucleus, tetrazole nucleus, pyridine nucleus and nucleus obtained by fusion of alicyclic hydrocarbon rings to these nucleus or nucleus obtained by fusion of aromatic hydrocarbon rings to these groups, e.g., indolenine nucleus, benzindolenine nucleus, indole nucleus, benzoxazole nucleus, naphthooxazole nucleus, benzothiazole nucleus, naphthothiazole nucleus, benzoselenazole nucleus, benzimidazole nucleus and quinoline nucleus. These nucleus may be applied to carbon atoms in the dyes.

Examples of suitable nucleus which can be applied to melocyanine dye or composite melocyanine dye include 5- or 6-membered heterocyclic nucleus such as pyrazoline-5-one nucleus, thiohydantoin nucleus, 2-thiooxazoline-2,4-dione nucleus, thiazoline-2,4-dione nucleus, rhodanine nucleus, and thiobarbituric acid nucleus.

These sensitizing dyes can be used singly or in combination. Such a combination of sensitizing dyes is often used for the purpose of supersensitization.

In combination with the sensitizing dye, a dye which doesn't exhibit a spectral sensitizing effect itself or a substance which doesn't substantially absorb visible light but exhibits a supersensitizing effect can be incorporated in the emulsion.

The photographic emulsion to be used in the present invention may comprise surface active agents singly or in combination.

These surface active agents are used as coating aids but may often be used for the purpose of facilitating emulsion dispersion, facilitating sensitization, improving photographic properties, inhibiting static charge, inhibiting adhesion or like purposes. These surface active agents can be classified into some groups: natural surface active agent such as saponine, nonionic surface active agent such as alkylene oxide, glycerin and glycidol, cationic surface active agent such as high alkylamine, quaternary ammonium salt, pyridine, other heterocyclic groups, phosphonium and sulfonium, anionic surface active agent containing an acidic group such as carboxylic acid, sulfonic acid, phosphoric acid, sulfuric ester group and phosphoric ester group, and amphoteric surface active agent such as amino acid, aminosulfonic acid, and sulfonic or phosphoric ester of aminoalcohol. When such a surface active agent is used as an anstatic agent, a fluorine-containing surface active agent is preferably used.

The photographic emulsion to be used in the present invention can comprise various compounds for the storage or photographic processing of the light-sensitive material or stabilizing the photographic properties. In particular, there can be used many compounds known as fog inhibitors or stabilizers. Examples of these fog inhibitors or stabilizers include azoles such as benzothiazolium salt, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (particularly 1-phenyl-5-mercaptotetrazole), mercaptopyrimidines, mercaptotriazines, thioketo compounds such as oxadolinethione, azaindenes such as triazaindenes, tetraazaindenes (particularly 4-hydroxy-substituted (1,3,3a,7)tetraazaindenes), and pentaazaindenes, benzenethiosulfonic acid, benzenesulfinic acid, and benzenesulfonic amide.

The photographic emulsion layer in the present hotographic light-sensitive material may comprise thioether compound, thiomorpholine, quaternary ammonium salt, urethane derivative, urea derivative, imidazole derivative, 3-pyrazolidone or the like for the purpose of improving sensitivity or contrast or accelerating development.

The photographic emulsion layer or other hydrophilic colloid layers of the photographic light-sensitive material to be used in the present invention may comprise a dispersion of a synthetic polymer insoluble or difficultly soluble in water for the purpose of improving dimensional stability. Examples of such a synthetic polymer include alkyl(meth)acrylate, alkoxyalkyl(meth)acrylate, acrylonitrile, olefin, and styrene, singly or in combination, and polymer comprising a monomer component combinations of these compounds with acrylic acid, methacrylic acid, $\alpha$, $\beta$-unsaturated dicarboxylic acid or the like.

As a suitable binder to be incorporated in the emulsion layer or auxiliary layers (e.g., protective layer, interlayer) in the present light-sensitive material there may be advantageously used a hydrophilic colloid, particularly gelatin. Other hydrophilic colloids may be used. Examples of such hydrophilic colloids which can be used in the present invention include protein such as gelatin derivatives, graft polymer of gelatin with other high molecular compounds, albumine, and casein, saccharide derivative such as hydroxyethyl cellulose, carboxymethyl cellulose, cellulose ester sulfate, sodium alginate, and starch derivative, monopolymer or copolymer such as polyvinyl alcohol, polyvinyl alcohol partial acetal, poly-N-vinyl pyrrolidone, polyacrylic acid, polymethacrylic acid, polyacrylamide, polyvinyl imidazole, and polyvinyl pyrazole, and other various synthetic hydrophilic high molecular compounds. Besides these compounds, lime-treated gelatin, acid-treated gelatin, enzyme-treated gelatin and the like can be used.

The present light-sensitive material can comprise an inorganic or organic film hardener in any other hydrophilic colloid layers. Specific examples of such a film hardener include chromium salt (e.g., chromium alum, chromium acetate), aldehyde (e.g., formaldehyde, glyoxal, glutaraldehyde), and N-methylol compound (e.g., dimethylurea, methylol dimethylhydantoin), dioxane derivative (e.g., 2,3-dihydroxydioxane), active vinyl compound (e.g., 1,3,5-triacryloyl-hexahydro-s-triazine, 1,3-vinylsulfonyl-2-propanol), active halogen compound (e.g., 2,4-dichloro-6-hydroxy-s-triazine), mucohalogenic acid (e.g., mucochloric acid, mucophenoxychloric acid), and combination thereof.

The present silver halide photographic material can comprise other various additives such as brightening agent, dye, desensitizer, coating aid, anstatic agent, plasticizer, lubricant, matt agent, development accelerator, mordant, ultraviolet absorber, discoloration inhibitor, and color fog inhibitor.

As such additives there can be used those described in *Research Disclosure* No. 17643, 1978, p. 22–31.

The present invention can be applied to various silver halide photographic materials as further discussed hereinafter.

For example, the compound of the present invention can be effectively used to improve the quality of a silver halide photographic material for photomechanical process comprising silver chlorobromide or silver chloroiodobromide emulsion layers (preferably monodisperse) containing at least 60% of silver chloride and 0 to 5% of silver iodide and containing polyalkylene oxides. In particular, if PUG in the compound (I) or (II) is a development inhibitor, it can improve the bottom sharpness without deteriorating dot quality. In this case, the present compound is preferably used in an amount of $1\times10^{-7}$ to $1\times10^{-1}$ mol, particularly $1\times10^{-6}$ to $1\times10^{-2}$ mol per mol of silver halide.

The polyalkylene oxide compound to be used in this case may be incorporated in either or both of the silver halide photographic material and the developer.

Examples of such a polyalkylene oxide compound include condensate of polyalkylene oxide consisting of at least 10 units of $C_{2-4}$ alkylene oxide such as ethylene oxide, propylene-1,2-oxide and butylene-1,2-oxide, preferably ethylene oxide, with a compound containing at least one active hydrogen atom such as water, aliphatic alcohol, aromatic alcohol, aliphatic acid, organic amine and hexitol derivative, and block copolymer of two or more polyalkylene oxides. Specific examples of polyalkylene oxide compounds which can be used in the present invention include polyalkylene glycol, polyalkylene glycol alkyl ether, polyalkylene glycol aryl ether, polyalkylene glycol (alkylaryl) ester, polyalkylene glycol ester, polyalkylene glycol aliphatic acid amide, polyalkylene glycol amine, polyalkylene glycol block copolymer, and polyalkylene glycol graft polymer.

Such a polyalkylene oxide compound preferably has a weight average molecular weight of 500 to 10,000.

These polyalkylene oxide compounds can be used singly or in combination.

If the above mentioned polyalkylene oxide compound is incorporated in a silver halide photographic material, its content is in the range of $5\times10^{-4}$ g to 5 g, preferably $1\times10^{-3}$ g to 1 g per mol of silver halide. If the above mentioned polyalkylene oxide compound is incorporated in a developer, its content may be in the range of 0.1 g to 10 g per 1 liter of developer.

The present invention can also be effectively used to eliminate black spots on a photographic light-sensitive material comprising a monodisperse silver halide emulsion layer capable of forming ultrahigh contrast images with a stable developer when acted on by e derivative as disclosed in U.S. Pat. Nos. 4,224,401, 4,168,977, 4,241,164, 4,311,781, 4,272,606, 4,221,857, 4,243,739, 4,272,614, and 4,269,929. The term "black spot" as used herein means a "black spot (or black pepper)" developed on a nonimage portion (e.g., portion between dot and dot). This phenomenon occurs remarkably when the developer is fatigued after a prolonged use, causing a drop in the concentration of sulfurous ions as preservative or a rise in the pH value thereof. This phenomenon impairs photographic properties. The term "stable developer" as used herein refers to a developer containing sulfurous ions as preservative in an amount of at least 0.15 mol/l and having a pH value of 10.0 to 12.3. This developer can contain a large amount of preservatives and thus can be more stable than ordinary lithographic developer which can contain only a slight amount of sulfurous ions. This developer also exhibits a relatively low pH value and thus is less subject to air oxidation and more stable than the developer (pH=12.8) for ultrahigh contrast image formation system as disclosed in U.S. Pat. No. 2,419,975. In this case, PUG in the compounds of the general formulae (I) and (II) is preferably a development inhibitor. The present compound is preferably used in an amount of $1\times10^{-6}$ to $10^{-1}$ mol, particularly $1\times10^{-5}$ to $1\times10^{-1}$ mol per mol of silver halide.

In the present invention, if a hydrazine is incorporated in the photographic light-sensitive material, it is preferably incorporated in the silver halide emulsion layer but may be incorporated in any other light-insensitive hydrophilic colloidal layers (e.g., protective layer, interlayer, filter layer, antihalation layer). In particular, if the compound to be incorporated is soluble in water, it may be incorporated in a hydrophilic colloid solution in the form of aqueous solution. If the compound to be incorporated is difficultly soluble in water, it may be incorporated in a hydrophilic colloid solution in the form of solution in an organic solvent miscible with water such as alcohol, ester and ketone. If the hydrazine derivative is incorporated in the silver halide emulsion layer, the incorporation may be effected at any time between the beginning of chemical ripening and before coating, preferably between the end of chemical ripening and before coating. In particular, the hydrazine derivative is preferably incorporated in a coating solution prepared for coating.

The optimum content of the hydrazine derivative is preferably selected depending on grain diameter, halogen composition and process and degree of chemical sensitization of silver halide grains, relationship between the layer in which the hydrazine derivative is incorporated and the silver halide emulsion layer, type of fog-inhibiting compound, etc. Test methods for the selection of the optimum content of the hydrazine derivative are well known by those skilled in the art. In general, the optimum content of the hydrazine derivative is preferably in the range of $10^{-6}$ to $1\times10^{-1}$ mol, particularly $10^{-5}$ to $4\times10^{-2}$ mol per mol of silver halide.

The present invention can be applied to a multi-layer multi-color photographic material comprising at least two spectral sensitivities on a support mainly for the purpose of inhibiting fog, adjusting gradation, improving color reproducibility and providing higher sensitivity. Such a multi-layer multi-color photographic material comprises at least one red-sensitive emulsion layer, one green-sensitive emulsion layer and one blue-sensitive emulsion layer on a support. The order of arrangement of these layers is optional. In a preferred embodiment, a red-sensitive emulsion layer, a green-sensitive emulsion layer and a blue-sensitive emulsion layer or a blue-sensitive emulsion layer, a red-sensitive emulsion layer and a green-sensitive emulsion layer are arranged from the support in this order. These emulsion layers each may consist of two or more emulsion layers having different sensitivities. Further, a light-insensitive layer may be provided between two or more emulsion layers having the same sensitivity. In general, the red-sensitive emulsion layer contains a cyan-forming coupler, the green-sensitive emulsion layer contains a magenta-forming coupler, and the blue-sensitive emulsion layer contains a yellow-forming coupler. However, different combinations can be used.

Couplers which can be used in the present invention are not specifically limited. Examples of magenta couplers which can be used include 5-pyrazolone coupler, pyrazolotriazole coupler, pyrazolobenzimidazole coupler, cyanoacetyl coumarone coupler, and open chain acylacetonitrile coupler. Examples of yellow couplers which can be used include acylacetamide coupler (e.g., benzoylacetanilide, pivaloylacetanilide). Examples of cyan couplers which can be used include naphthol coupler, and phenol coupler. Other examples of cyan couplers include ureide cyan coupler, and diacylaminophenol coupler. These couplers are preferably non-diffusive groups containing a hydrophobic group called ballast group in their molecule or polymerized groups. These couplers may be two-equivalent or four-equivalent to silver ion. Alternatively, these couplers may be colored couplers having a color correcting effect or couplers which release a development inhibitor or development accelerator upon development (so-called DIR coupler or DAR coupler).

The present light-sensitive material may contain a colorless DIR coupling compound which provides a colorless product of coupling reaction and releases a development inhibitor besides DIR couplers.

The present light-sensitive material may contain a compound which releases a development inhibitor upon development besides DIR couplers.

It goes without saying that two or more these couplers may be incorporated in the same layer or the same compound may be incorporated in two or more different layers in order to meet requirements for light-sensitive material.

The present compound may be incorporated in the same layer as these couplers in combination therewith. The present compound may be incorporated in an auxiliary photographic layer such as interlayer as a separate emulsion dispersion.

The present compound is used in an amount of 0.1 to 50 mol %, preferably 0.3 to 15 mol % based on yellow coupler in the blue-sensitive layer, magenta coupler in the green-sensitive layer or cyan coupler in the red-sensitive layer in the color light-sensitive material, or preferably $1\times10^{-5}$ to $8\times10^{-2}$ mol, particularly $1\times10^{-4}$ to $5\times10^{-2}$ mol per mol of silver halide in the layer in which it is incorporated.

In the light-sensitive material prepared according to the present invention, if the hydrophilic colloid layer contains a dye or ultraviolet absorbent, these additives may be mordanted by a cationic polymer.

The light-sensitive material prepared according to the present invention may contain as color fog inhibitor a hydroquinone derivative, aminophenol derivative, gallic acid derivative, ascorbic acid derivative or the like.

The light-sensitive material prepared according to the present invention may contain an ultraviolet absorbent in the hydrophilic colloid layer. Examples of such an ultraviolet absorbent which can be used include aryl-substituted benzotriazole compounds as disclosed in U.S. Pat. No. 3,533,794, 4-thiazolidone compounds as disclosed in U.S. Pat. Nos. 3,214,794 and 3,352,681, and benzophenone compounds as disclosed in JP-A-46-2784. These ultraviolet absorbents may be mordanted in certain layers.

The light-sensitive material prepared according to the present invention may contain a water-soluble dye in the hydrophilic colloid layer as a filter dye or for the purpose of inhibiting irradiation or like purposes. Examples of such a dye include oxonol dye, hemioxonol dye, styryl dye, melocyanine dye, cyanine dye, and azo dye. Particularly useful among these dyes are oxonol dye, hemioxonol dye and melocyanine dye.

In an embodiment of the present invention, the following known discoloration inhibitors may be used in combination with the above mentioned compounds. In the present invention, dye stabilizers can be used singly or in combination. Examples of known discoloration inhibitors include hydroquinone derivatives, gallic acid derivatives, p-alkoxyphenols, p-oxyphenol derivatives, and bisphenols.

The photographic processing of the present light-sensitive material can be accomplished by any known method. As processing solutions there can be used known processing solutions. The processing temperature can be normally selected between 18° C. and 50° C. but may be lower than 18° C. or higher than 50° C. Development processing for the formation of silver images (black-and-white photographic processing) or color photographic processing which comprises development processing for the formation of dye images can be applied depending on the purpose of application. Alternatively, heat development can be applied.

The developing solution to be used for black-and-white processing can comprise any known developing agent such as dihydroxybenzenes (e.g., hydroquinone), 3-pyrazolidones (e.g., 1-phenyl-3-pyrazolidone), and aminophenols (e.g., N-methyl-p-aminophenol), singly or in combination.

The color developer normally consists of an alkaline aqueous solution containing a color developing agent. As such a color developing agent there can be used a known primary aromatic amine developing agent such as phenylenediamine (e.g., 4-amino-N,N-diethylaniline, 3-methyl-4-amino-N,N-diethylaniline, 4-amino-N-ethyl N-β-hydroxyethylaniline, 3-methyl-4-amino-N-ethyl-N-β-hydroxyethylaniline, 3-methyl-4-amino-N-ethyl-N-β-methanesulfonamideethylaniline, 4-amino-3-methyl-N-ethyl-N-β-methoxyethylaniline).

Other examples of color developing agents which can be used in the present invention include those described in L. F. A. Mason, "Photographic Processing Chemistry", Focal Press (1966), pp. 226–229, U.S. Pat. Nos. 2,193,015, and 2,592,364, and JP-A-48-64933.

The present light-sensitive material which has been subjected to development is then subjected to known processing steps such as fixing, bleach, stabilization, blix, stop, and rinse (stabilization). In the rinse and stabilization steps, the method wherein the amount of water to be consumed is drastically limited may be used.

The present invention will be further described in the following examples, but the present invention should not be construed as being limited thereto.

EXAMPLE 1

An aqueous solution of silver nitrate and an aqueous solution of sodium chloride were simultaneously added to an aqueous solution of gelatin which had been kept at a temperature of 40° C. in the presence of $5.0\times10^{-6}$ mol of $(NH_4)_3RhCl_6$. Soluble salts were removed by a method known in the art. Gelatin was then added to the reaction system. The reaction system was not subjected to chemical ripening. 2-Methyl-4-hydroxy-1,3,3a,7-tetraazaindene was added to the reaction system as a stabilizer. Thus, a monodisperse emulsion of cubic grains with an average grain size of 0.2 μm was obtained.

Compound A, the present compounds I-2, I-4, and I-37, and Comparative Compounds a, b and c were added to the emulsion in amounts as set forth in Table 1. A polyethyl acrylate latex was added to the emulsion in a solid content of 30 wt. % based on gelatin. 1,3-Vinylsulfonyl-2-propanol was then added to the emulsion as film hardener. The emulsion was coated on a polyester support in such an amount that the coated amount of silver and gelatin reached 3.8 g/m² and 1.8 g/m². Gelatin was further coated on the emulsion coat in an amount of 1.5 gm/m² as a protective layer.

The specimens thus prepared were exposed to light through an optical wedge in a daylight printer Model P-607 available from Dainippon Screen Mfg. Co., Ltd. (Specimen A free of organic desensitizer was exposed to light with an ND filter having a density of 2.0 superimposed on the optical wedge), developed with the following developer at a temperature of 38° C. for 30 seconds, fixed, washed with water, and then dried.

| Developer | |
|---|---|
| Hydroquinone | 45.0 g |
| N-methyl-p-aminophehol ½ sulfate | 0.8 g |
| Sodium hydroxide | 18.0 g |
| Potassium hydroxide | 55.0 g |
| 5-Sulfosalicylic acid | 45.0 g |
| Boric acid | 25.0 g |
| Potassium sulfite | 110.0 g |
| Disodium ethylenediamine-tetracetate | 1.0 g |
| Potassium bromide | 6.0 g |
| 5-Methylbenzotriazole | 0.6 g |
| 2-Mercaptobenzimidazole-5-sulfonic acid | 0.3 g |
| Sodium 3-(5-Mercaptotetrazole) benzosulfonate | 0.2 g |
| n-Butyl-Diethanol-amine | 15.0 g |
| Water to make | 1 l |
| pH | 11.6 |

The photographic properties were evaluated in the manner as described later. The results (Photographic Property 1) are set forth in Table 1.

The relative sensitivity was determined as reciprocal of the exposure giving a density of 1.5 upon development at 38° C. for 30 seconds relative to that of Specimen 1 as 100.

The black spot was determined by a 5-level evaluation under a microscope. Level 5 indicates the best quality, and Level 1 indicates the poorest quality. Level 5 and Level 4 are practicable. Level 3 is poor but is the lower limit of practical use. Level 2 and Level 1 are impracticable. A level in between Level 3 and Level 4 is represented as Level 3.5. A level in between Level 4 and Level 5 is represented as Level 4.5.

The black spot was evaluated upon development at 38° C. for 40 seconds.

Gradation (γ): Represented as inclination of the straight line between the points of a density of 0.3 and a density of 3.0 on the characteristic curve. The greater this value is, the higher is the contrast.

Another batch of these specimens which had not been processed were allowed to stand at a temperature of 50° C. and a relative humidity of 75% for 3 days, and then determined for photographic properties in the same manner as mentioned above. The results (Photographic Property 2) are set forth in Table 1.

TABLE 1

| Specimen No. | Added Amount of Compound A (mol/molAg) | Type of Present and Comparative Compounds | Added Amount of Present and Comparative Compounds (mol/molAg) | Photographic Property 1 | | | Photographic Property 2 | |
|---|---|---|---|---|---|---|---|---|
| | | | | Sensitivity | Gradation (γ) | Black Spot | Sensitivity | Gradation (γ) |
| 1 | $3 \times 10^{-4}$ | — | — | 100 | 14.0 | 3 | 98 | 13.7 |
| 2 | $4 \times 10^{-4}$ | — | — | 101 | 15.1 | 2 | 102 | 14.6 |
| 3 | $3 \times 10^{-4}$ | Compound I-2 | $5.4 \times 10^{-4}$ | 98 | 13.8 | 4 | 97 | 13.5 |
| 4 | $3 \times 10^{-4}$ | Compound I-2 | $1.1 \times 10^{-3}$ | 93 | 13.5 | 4.5 | 91 | 13.3 |
| 5 | $4 \times 10^{-4}$ | Compound I-2 | $1.1 \times 10^{-3}$ | 101 | 14.8 | 4 | 100 | 14.2 |
| 6 | $3 \times 10^{-4}$ | Compound I-37 | $5.4 \times 10^{-4}$ | 98 | 13.7 | 4 | 96 | 13.3 |
| 7 | $3 \times 10^{-4}$ | Compound I-37 | $1.1 \times 10^{-3}$ | 93 | 13.3 | 4.5 | 92 | 13.0 |
| 8 | $3 \times 10^{-4}$ | Compound I-4 | $5.4 \times 10^{-4}$ | 103 | 15.0 | 4 | 101 | 14.3 |
| 9 | $3 \times 10^{-4}$ | Comparative Compound a | $5.4 \times 10^{-4}$ | 88 | 11.6 | 4.5 | 78 | 9.0 |
| 10 | $3 \times 10^{-4}$ | Comparative Compound a | $1.1 \times 10^{-3}$ | 76 | 10.4 | 5 | 67 | 8.0 |
| 11 | $3 \times 10^{-4}$ | Comparative Compound b | $5.4 \times 10^{-4}$ | 90 | 12.0 | 4.5 | 79 | 9.2 |
| 12 | $3 \times 10^{-4}$ | Comparative Compound c | $5.4 \times 10^{-4}$ | 98 | 10.6 | 3 | 82 | 9.8 |

Compound A:

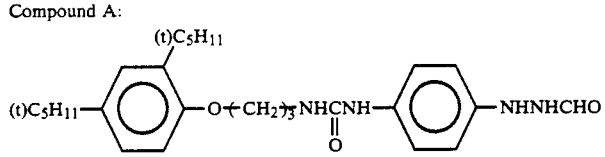

Comparative Compound a:

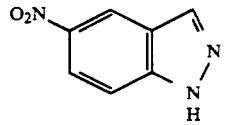

Comparative Compound b:
(Hydrolyzable precursor as disclosed in U.S. Pat. No. 3,575,699)

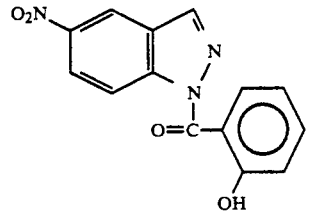

Comparative Compound c:
(Compound exemplified by general formula in JP-A-55-7576)

-continued

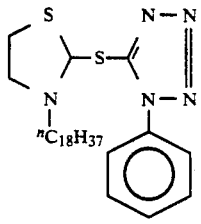

Table 1 shows that Specimens 1 and 2, free of the present compound, exhibit excellent sensitivity and gradation but exhibit a poor black spot characteristic. Comparative Specimens 9 and 10, comprising Comparative Compound a, exhibit an excellent black spot characteristic but exhibit a low sensitivity and a low contrast. Further, Comparative Specimens 11 and 12, comprising extremely unstable Comparative Compounds b and c, exhibit a remarkable drop in sensitivity and gradation, particularly in a forced deterioration test (Photographic Property 2).

On the other hand, Specimens 3 to 8, comprising the compound of the general formula (I), exhibit excellent sensitivity, gradation and black spot characteristic. Further, Specimens 3 to 8 still exhibit excellent sensitivity and gradation in a forced deterioration test.

EXAMPLE 2

Preparation of Emulsion

An aqueous solution of silver nitrate and an aqueous solution of sodium hexachloride containing ammonium hexachlorinated rhodiumate (III) in an amount of $1.0\times10^{-4}$ were mixed in a gelatin solution at a temperature of 35° C. in a double jet process with the pH value of the system controlled to 2.3. Thus, a monodisperse emulsion of silver chloride grains having an average grain size of 0.1 μm was obtained.

After the formation of grains, soluble salts were removed by the flocculation process known in the art. 4-Hydroxy-6-methyl-1,3,3a,7-tetrazaindene and 1-phenyl-5-mercaptotetrazole were added to the system as stabilizers. The emulsion contained gelatin and silver in amounts of 55 g and 105 g per kg.

Preparation of Light-Sensitive Material

A nucleating agent D-1 of the following general formula and an organic densitizer were added to the emulsion thus prepared in amounts of 9 mg/g silver and 2 mg/g silver, respectively.

D-1

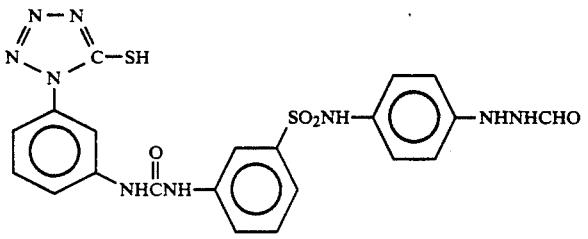

Organic densitizer

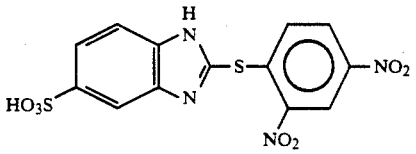

Further, 2,4-dichloro-6-hydroxy-1,3,5-triazine sodium salt was added to the emulsion as a film hardener. The silver halide emulsion thus prepared was coated on a transparent polyethylene terephthalate support in such an amount that the coated amount of silver reached 3.5 g/m². A protective layer comprising gelatin (1.3 g/m²) and the present compound (I-19) (0.14 g/m²) was coated on the upper layer, and then dried to obtain Specimen 1.

The gelatin dispersion for the present compound (I-19) was prepared as follows:

6.9 g of Compound (I-19) was dissolved in the equimolecular amount of 1N NaOH and 39 ml of methyl ethyl ketone. The solution was then added to 260 g of a 5.0 wt. % aqueous solution of gelatin with stirring at a temperature of 45° C. to obtain a slightly emulsified dispersion.

COMPARATIVE EXAMPLE 1

1) Specimen A was prepared in the same manner as in Example 2 except that Compound (I-19) was excluded.

2) Comparative Specimen B was prepared in the same manner as in Example 2 except that Compound (I-19) was replaced by 0.05 g/m² of a water-soluble ultraviolet-absorbing dye of the following general formula.

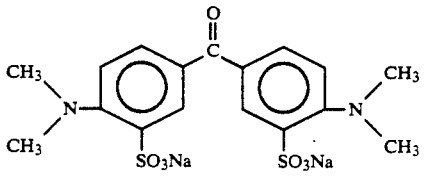

Evaluation of Properties (1) The three specimens thus prepared were exposed to light through an optical wedge in a daylight printer Model P-607 available from Dainippon Screen Mfg. Co., Ltd., developed with the following developer at a temperature of 38° C. for 20 seconds, and then subjected to fixing, rinse and drying in commonly used manners. Specimens B and Specimen 1 exhibit a low UV optical density at highlighted portions as Specimen A and thus exhibit full discoloration.

| Basic formulation of developer | |
|---|---|
| Hydroquinone | 35.0 g |
| N-methyl-p-aminophehol ½ sulfate | 0.8 g |
| Sodium hydroxide | 13.0 g |
| 5-Sulfosalicylic acid | 74.0 g |
| Potassium sulfite | 90.0 g |
| Tetrasodium ethylenediamine-tetracetate | 1.0 g |
| Potassium bromide | 4.0 g |
| 5-Methylbenzotriazole | 0.6 g |
| 3-Diethylamino-1,2-propanediol | 15.0 g |
| Water to make | 1 l |
| pH | 11.5 |

The sensitivity of Comparative Specimen B and Present Specimen 1 were 0.4 and 0.5 lower than that of Comparative Specimen A as calculated in terms of log E. In practical use, Specimen B and Specimen 1 exhibit an optimum range of sensitivity.

(2) Test for safety to safelight

The three specimens thus obtained were examined for safe time under 400 lux light from UV cut fluorescent light (FLR-40SW-DLX-NU/M of Toshiba Corp.) as safelight. Comparative Specimen B and Present Specimen 1 exhibit 25 minutes and 35 minutes, respectively, while Comparative Specimen A exhibits 10 minutes.

The results of Tests (1) and (2) show that Present Compound (I-19) provides a further effective reduction of the sensitivity to an optimum range and an improvement in safety to safelight.

(3) Test for tone variability

The three specimens were exposed to light through a net screen in the above mentioned printer, and then developed in the same manner as in Test (1). For each specimen, the exposure time which enables 1:1 reversal was determined. These specimens were then exposed to light for twice and four times this exposure time. Thus, the degree of exansion of dot area was examined. The greater this value is, the more excellent is the tone variability. The results are set forth in Table 2. Table 2 shows that Comparative Specimen B exhibits a remarkable drop in the tone variability while Present Specimen 1 exhibits a high tone variability. This is because that since the dye incorporated in Comparative Specimen B is soluble in water and diffusive, it diffuses uniformly from the layer in which it is incorporated to the light-sensitive emulsion layer, causing the dye to exhibit an anti-irradiation effect to inhibit the expansion of dot area even if the exposure time increases. On the other hand, since Present Compound (I-19) is fixed to the layer in which it is incorporated, a high tone variability can be attained.

TABLE 2

| Tone variability (represented as rise in dot area) | | |
|---|---|---|
| Specimen No. | Two-fold exposure | Four-fold exposure |
| Specimen A (comparative) | +5% | +9% |
| Specimen B (comparative) | +2% | +4% |
| Specimen 1 (present) | +5% | +9% |

(4) Evaluation of stain by reducer

A strip of Present Specimen 1 which had been subjected to processing in Test (3) was dipped in the following Farmer's reducer at a temperature of 20° C. for 60 seconds, washed with water, and then dried. As a result, the portions having a 50% dot area were reduced to 32%, and there occurred no stain.

| Farmer's reducer | |
|---|---|
| First Solution | |
| Water | 200 ml |
| Sodium thiosulfate | 20 g |
| Second Solution | |
| Water | 100 ml |
| Red prussiate | 10 g |

Prior to use, First Solution, Second Solution and water are mixed in a proportion of 100 parts: 5 parts: 100 parts.

EXAMPLE 3

Specimens 2a, 2b and 2c were prepared in the same manner as in Example 2 except that the present Compounds (I-26), (I-35) and (I-39) were used instead of Compound (I-19) in amounts of $1.26\times10^{-4}$ mol/m$^2$, respectively, and then evaluated in the same manner as in Example 2.

As a result, these specimens exhibited an effective drop of sensitivity to an optimum range, enhanced safety to safelight and great tone variability. Further, there occurred no stain due to the processing with a reducer.

EXAMPLE 4

A multilayer color light-sensitive material specimen 401 was prepared by coating on an undercoated cellulose triacetate film support various layers having the following compositions:

Composition of Light-Sensitive Layer

The coated amount of silver halide and colloidal silver is represented in g/m$^2$ as calculated in terms of amount of silver. The coated amount of coupler, additives and gelatin is represented in g/m$^2$. The coated amount of sensitizing dye is represented in molar amount per mol of silver halide in the same layer. The symbols indicate the following meanings. If an additive has a plurality of effects, one effect is described on behalf of them.

UV: ultraviolet absorbent; Solv: high boiling organic solvent; ExF: dye; ExS: sensitizing dye; ExC: cyan coupler; ExM: magenta coupler; ExY: yellow coupler; Cpd: additive

| 1st Layer: anti-halation layer | |
|---|---|
| Black colloidal silver | 0.15 |
| Gelatin | 2.9 |
| UV-1 | 0.03 |

-continued

| | |
|---|---|
| UV-2 | 0.06 |
| UV-3 | 0.07 |
| Solv-2 | 0.08 |
| ExF-1 | 0.01 |
| ExF-2 | 0.01 |
| 2nd Layer: low sensitivity red-sensitive emulsion layer | |
| Silver iodobromide emulsion (AgI content: 4 mol %; uniform AgI content type; grain diameter: 0.4 μm as calculated in terms of sphere; grain diameter fluctuation coefficient: 37% as calculated in terms of sphere; tabular grain; diameter/thickness ratio: 3.0) | 0.4 (as silver) |
| Gelatin | 0.8 |
| ExS-1 | $2.3 \times 10^{-4}$ |
| ExS-2 | $1.4 \times 10^{-4}$ |
| ExS-5 | $2.3 \times 10^{-4}$ |
| ExS-7 | $8.0 \times 10^{-6}$ |
| ExC-1 | 0.17 |
| ExC-2 | 0.03 |
| ExC-3 | 0.13 |
| 3rd layer: middle sensitivity red-sensitive emulsion layer | |
| Silver iodobromide emulsion (AgI content: 6 mol %; high internal AgI type with core/shell ratio of 2:1; grain diameter: 0.65 μm as calculated in terms of sphere; grain diameter fluctuation coefficient: 25% as calculated in terms of sphere; tabular grain; diameter/thickness ratio: 2.0) | 0.65 (as silver) |
| Silver iodobromide emulsion (AgI content: 4 mol %; uniform AgI type; grain diameter: 0.4 μm as calculated in terms of sphere; grain diameter fluctuation coefficient: 37% as calculated in terms of sphere; tabular grain; diameter/thickness ratio: 3.0) | 0.1 (as silver) |
| Gelatin | 1.0 |
| ExS-1 | $2.0 \times 10^{-4}$ |
| ExS-2 | $1.2 \times 10^{-4}$ |
| ExS-5 | $2 \times 10^{-4}$ |
| ExS-7 | $7 \times 10^{-6}$ |
| ExC-1 | 0.31 |
| ExC-2 | 0.01 |
| ExC-3 | 0.06 |
| 4th Layer: high sensitivity red-sensitive emulsion layer | |
| Silver iodobromide emulsion (AgI content: 6 mol %; high internal AgI type with core/shell ratio of 2:1; grain diameter: 0.7 μm as calculated in terms of sphere; grain diameter fluctuation coefficient: 25% as calculated in terms of sphere; tabular grain; diameter/thickness ratio: 2.5) | 0.9 (as silver) |
| Gelatin | 0.8 |
| ExS-1 | $1.6 \times 10^{-4}$ |
| ExS-2 | $1.6 \times 10^{-4}$ |
| ExS-5 | $1.6 \times 10^{-4}$ |
| ExS-7 | $6 \times 10^{-4}$ |
| ExC-1 | 0.07 |
| ExC 4 | 0.05 |
| Solv-1 | 0.07 |
| Solv-2 | 0.20 |
| Cpd-7 | $4.6 \times 10^{-4}$ |
| 5th Layer: interlayer | |
| Gelatin | 0.6 |
| UV-4 | 0.03 |
| UV-5 | 0.04 |
| Cpd-1 | 0.1 |
| Polyethyl acrylate latex | 0.08 |
| Solv-1 | 0.05 |
| 6th Layer: low sensitivity green-sensitive emulsion layer | |
| Silver iodobromide emulsion (AgI content: 4 mol %; uniform type; grain diameter: 0.4 μm as calculated in terms of sphere;. grain diameter fluctuation coefficient: 37% as calculated in terms of sphere; diameter/thickness: 2.0) | 0.18 (as silver) |
| Gelatin | 0.4 |
| ExS-3 | $2 \times 10^{-4}$ |
| ExS-4 | $7 \times 10^{-4}$ |
| ExS-5 | $1 \times 10^{-4}$ |
| ExM-5 | 0.11 |
| ExM-7 | 0.03 |
| ExY-8 | 0.01 |
| Solv-1 | 0.09 |
| Solv-4 | 0.01 |
| 7th Layer: middle sensitivity green-sensitive emulsion layer | |
| Silver iodobromide emulsion (AgI content: 4 mol %; high surface AgI type with core/shell ratio of 1:1; grain diameter: 0.5 μm as calculated in terms of sphere; grain diameter fluctuation coefficient: 20% as calculated in terms of sphere; tabular grain; diameter/thickness ratio: 4.0) | 0.27 (as silver) |
| Gelatin | 0.6 |
| ExS-3 | $2 \times 10^{-4}$ |
| ExS-4 | $7 \times 10^{-4}$ |
| ExS-5 | $1 \times 10^{-4}$ |
| ExM-5 | 0.17 |
| ExM-7 | 0.04 |
| ExY-8 | 0.02 |
| Solv-1 | 0.14 |
| Solv-4 | 0.02 |
| 8th Layer: high sensitivity green-sensitive emulsion layer | |
| Silver iodobromide emulsion (AgI content: 8.7 mol %; multi-layer grain with silver amount ratio of 3:4:2; AgI content: 24 mol, 0 mol, 3 mol (towards surface); grain diameter: 0.7 μm as calculated in terms of sphere; grain diameter fluctuation coefficient: 25% as calculated in terms of sphere; tabular grain; diameter/thickness ratio: 1.6) | 0.7 (as silver) |
| Gelatin | 0.8 |
| ExS-4 | $5.2 \times 10^{-4}$ |
| ExS-5 | $1 \times 10^{-4}$ |
| ExS-8 | $0.3 \times 10^{-4}$ |
| ExM-5 | 0.1 |
| ExM-6 | 0.03 |
| ExY-8 | 0.02 |
| ExC-1 | 0.02 |
| ExC-4 | 0.01 |
| Solv-1 | 0.25 |
| Solv-2 | 0.06 |
| Solv-4 | 0.01 |
| Cpd-7 | $1 \times 10^{-4}$ |
| 9th Layer: interlayer | |
| Gelatin | 0.6 |
| Cpd-1 | 0.04 |
| Polyethyl acrylate latex | 0.12 |
| Solv-1 | 0.02 |
| 10th Layer: doner layer having an interlayer effect on red-sensitive layer | |
| Silver iodobromide emulsion (AgI content: 6 mol %; high internal AgI type with core/shell ratio of 2:1; grain diameter: 0.7 μm as calculated in terms of sphere; grain diameter fluctuation coefficient: 25%; tabular grain; diameter/thickness ratio: 2.0) | 0.68 (as silver) |
| Silver iodobromide emulsion (AgI content: 4 mol %; uniform type; grain diameter: 0.4 μm as calculated in terms of sphere; grain diameter fluctuation coefficient: 37%; tabular grain; diameter/thicknesss ratio: 3.0) | 0.19 (as silver) |
| Gelatin | 1.0 |
| ExS-3 | $6 \times 10^{-4}$ |
| ExM-10 | 0.19 |
| Solv-1 | 0.20 |

-continued

| | |
|---|---|
| 11th Layer: yellow filter layer | |
| Yellow colloidal silver | 0.06 |
| Gelatin | 0.8 |
| Cpd-2 | 0.13 |
| Solv-1 | 0.13 |
| Cpd-1 | 0.07 |
| Cpd-6 | 0.002 |
| H-1 | 0.13 |
| 12th Layer: low sensitivity blue-sensitive emulsion layer | |
| Silver iodobromide emulsion (AgI content: 4.5 mol %; uniform AgI type; grain diameter: 0.7 μm as calculated in terms of sphere; grain diameter fluctuation coefficient: 15% as calculated in terms of sphere; tabular grain; diameter/thickness ratio: 7.0) | 0.3 (as silver) |
| Silver iodobromide emulsion (AgI content: 3 mol %; uniform AgI type; grain diameter: 0.3 μm as calculated in terms of sphere; grain diameter fluctuation coefficient: 30% as calculated in terms of sphere; tabular grain; diameter/thickness ratio: 7.0) | 0.15 (as silver) |
| Gelatin | 1.8 |
| ExS-6 | $9 \times 10^{-4}$ |
| ExC-1 | 0.06 |
| ExC-4 | 0.03 |
| ExY-9 | 0.14 |
| ExY-11 | 0.89 |
| Solv-1 | 0.42 |
| 13th Layer: interlayer | |
| Gelatin | 0.7 |
| ExY-12 | 0.20 |
| Solv-1 | 0.34 |
| 14th Layer: high sensitivity blue-sensitive emulsion layer | |
| Silver iodobromide emulsion (AgI content: 10 mol %; high internal AgI type; grain diameter: 1.0 μm as calculated in tems of sphere; grain diameter fluctuation coefficient: 25% as calculated in terms of sphere; multiple twinning tabular grain; diameter/thickness ratio: 2.0) | 0.5 (as silver) |
| Gelatin | 0.5 |
| ExS-6 | $1 \times 10^{-4}$ |
| ExY-9 | 0.01 |
| ExY-11 | 0.20 |
| ExC-1 | 0.02 |
| Solv-1 | 0.10 |
| 15th Layer: 1st protective layer | |
| Emulsion of finely divided silver bromide grains (AgI content: 2 mol %; uniform AgI type: grain diameter: 0.07 μm as calculated in terms of sphere) | 0.12 (as silver) |
| Gelatin | 0.9 |
| UV-4 | 0.11 |
| UV-5 | 0.16 |
| Solv-5 | 0.02 |
| H-1 | 0.13 |
| Cpd-5 | 0.10 |
| Polyethyl acrylate latex | 0.09 |
| 16th Layer: 2nd protective layer | |
| Emulsion of finely divided silver bromide grains (AgI content: 2 mol %; uniform AgI type: grain diameter: 0.07 μm as calculated in terms of sphere) | 0.36 (as silver) |
| Gelatin | 0.55 |
| Polymethyl methacrylate grain (grain diameter: 1.5 μm) | 0.2 |
| H-1 | 0.17 |

Besides the above mentioned components, an emulsion stabilizer Cpd-3 (0.07 g/m$^2$) and a surface active agent Cpd-4 (0.03 g/m$^2$) as a coating aid were added to each of these layers.

UV-1

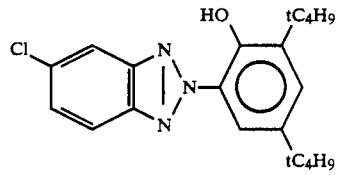

UV-2

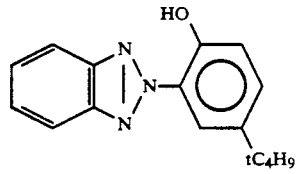

UV-3

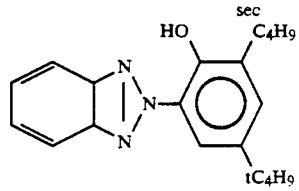

UV-4

-continued
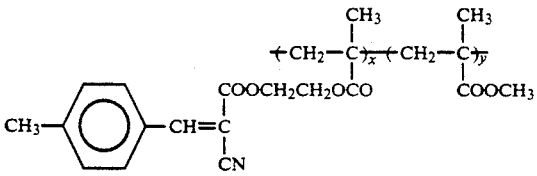
(x/y = 7/3 (by weight)
UV-5
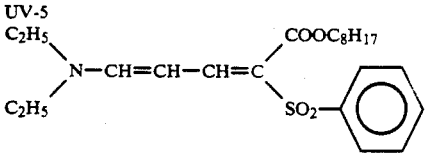
Solv-1:
Tricresyl phosphate
Solv-2:
Dibutyl phthalate
Solv-4
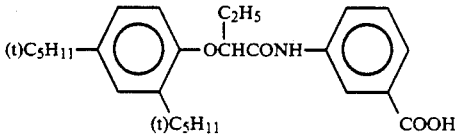
Solv-5:
Trihexyl phosphate
ExF-1
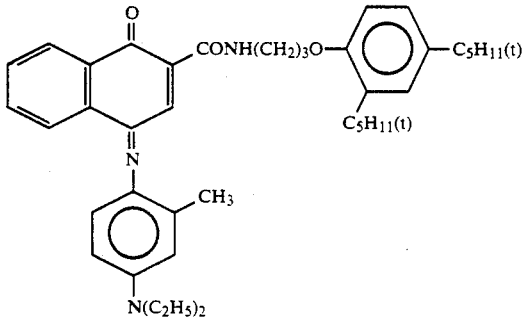
ExF-2
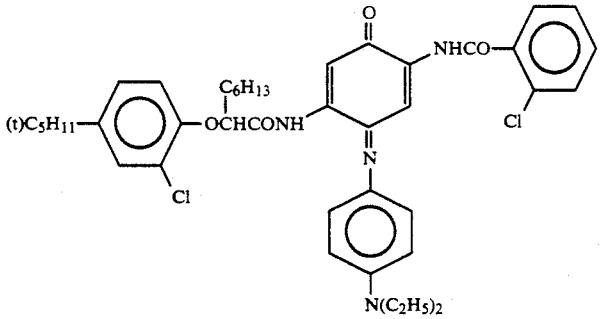
ExS-1
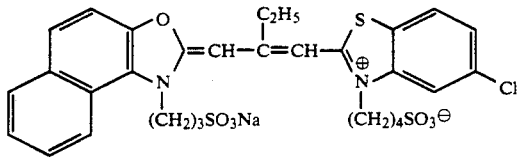

-continued
ExS-2
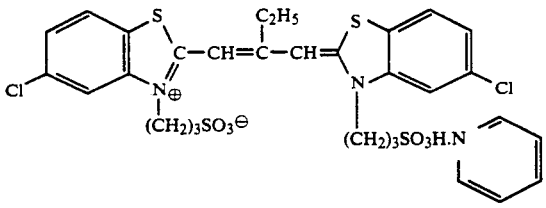
ExS-3
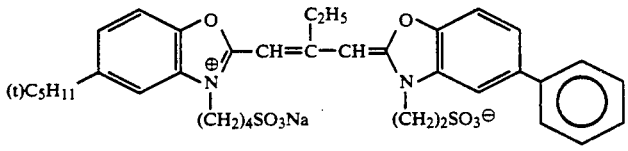
ExS-4
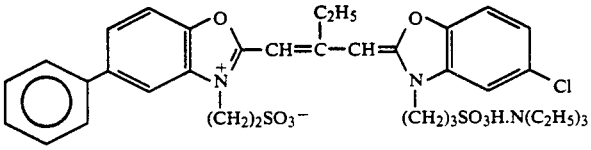
ExS-5
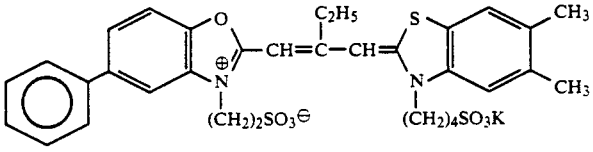
ExS-6
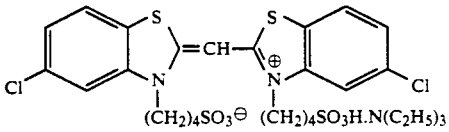
ExS-7
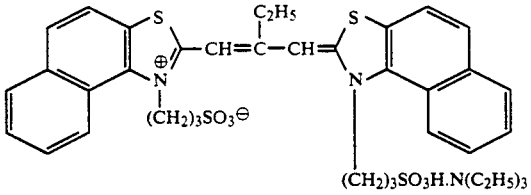
ExS-8
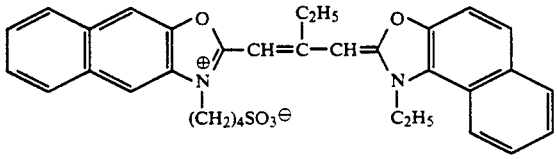
ExC-1
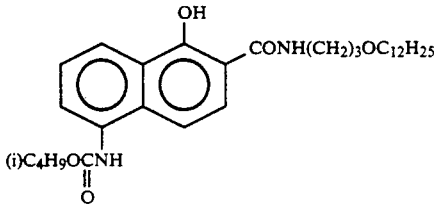

-continued
ExC-2
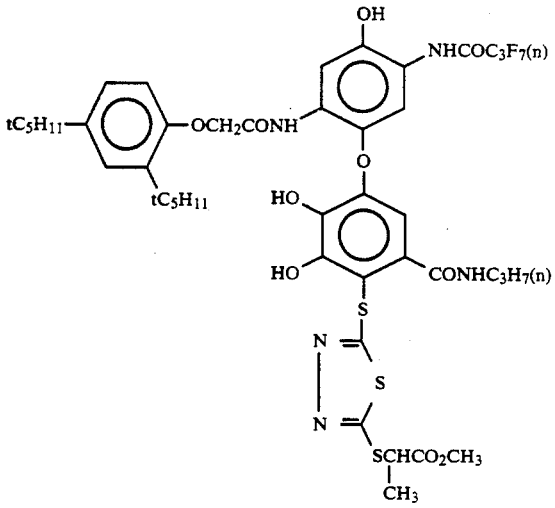
ExC-3
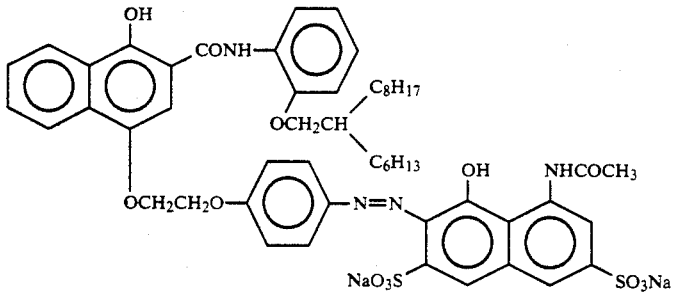
ExC-4
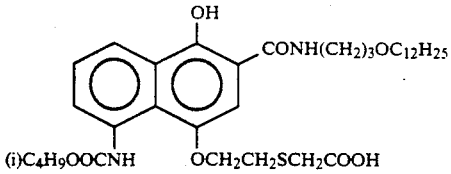
ExM-5
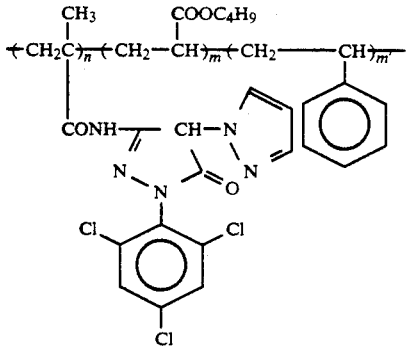
n = 50
m = 25
m' = 25
mol. wt. about 20,000
ExM-6

-continued
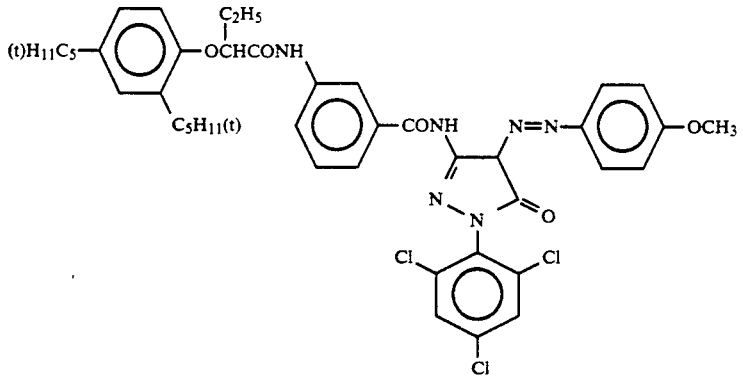
ExM-7
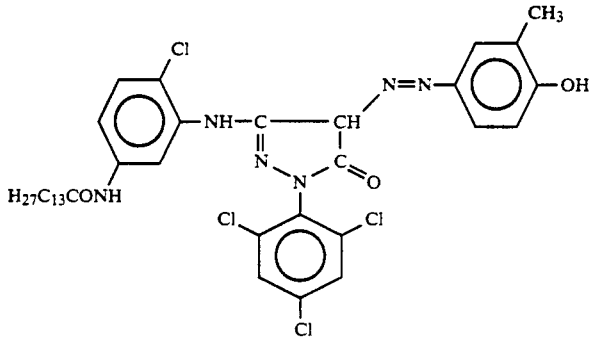
ExM-10
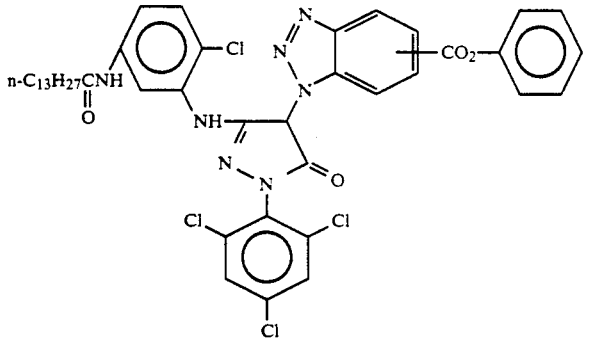
ExY-8
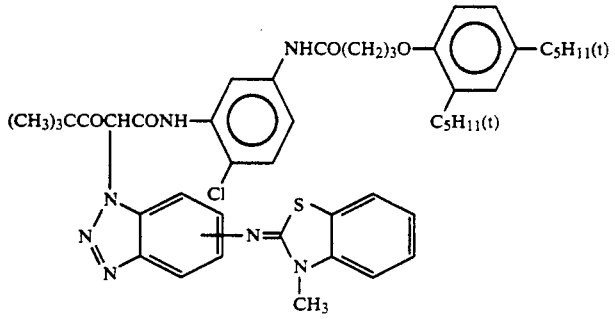
ExY-9

-continued
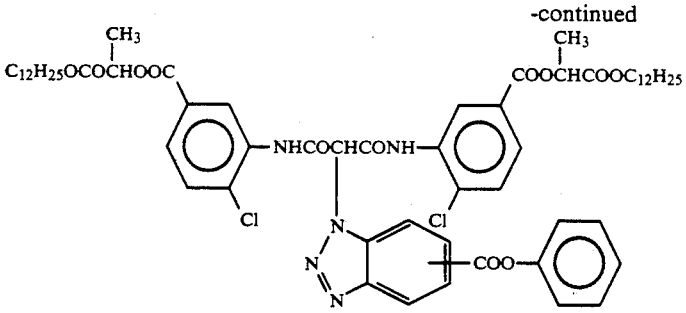
ExY-11
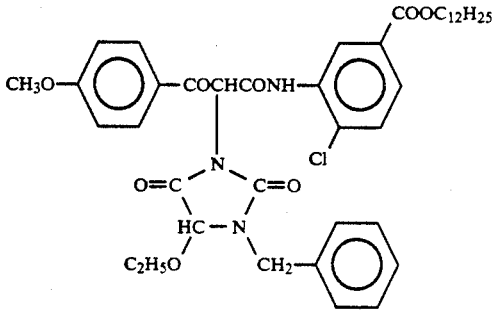
ExY-12
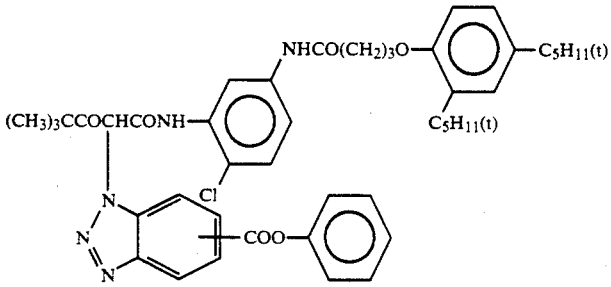
Cpd-7
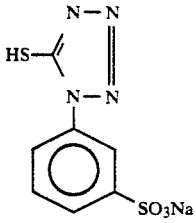
Cpd-1
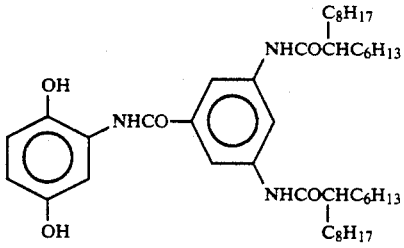
Cpd-2
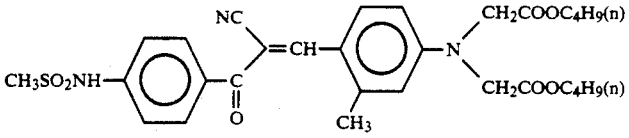

-continued

Cpd-6

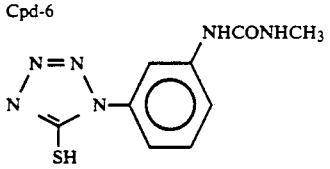

Cpd-5

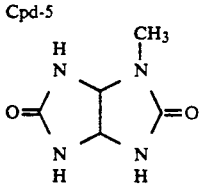

Cpd-3

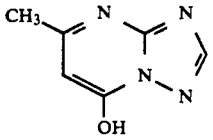

Cpd-4

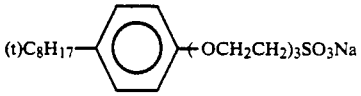

H-1

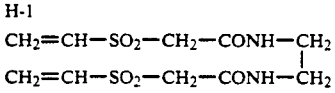

Preparation of Specimens 402 to 407

Specimens 402 to 407 were prepared in the same manner as in Specimen 401 except that the present compounds were additionally incorporated in the system as set forth in Table 3.

A standard object was photographed on Super HR-100 Film available from Fuji Photo Film Co., Ltd. The film was then subjected to running processing over 500 m in the step set forth in Table 4. After the running processing was completed, Specimens 401 to 407 were wedgewise exposed to white light of 20 CMS, and then processed in the step as set forth in Table 4. These specimens were then measured for amount of residual silver by a fluorescent X-ray. The results are set forth in Table 3.

Furthermore, in order to examine the preservability of fresh Specimens 401 to 407, these specimens were allowed to stand at a temperature of 55° C. and a relative humidity of 80% for 1 week, wedgewise exposed to light in the same manner as mentioned above, processed in the step as set forth in Table 4, and then evaluated for the change in photographic properties. The results are set forth in Table 3.

TABLE 3

| Specimen No. | Compound No./ added to * | Residual amount of silver ($mg/m^2$) | Sensitivity drop during 55° C./80% RH/ 1 W storage ** |
|---|---|---|---|
| 401 (comparative) | — | 47 | 0 |
| 402 (comparative) | Comparative Compound g/ 4th layer | 9 | −0.08 |
| 403 (comparative) | Comparative Compound g/ 8th layer | 22 | −0.05 |
| 404 (present invention) | I-30/4th layer | 9 | −0.03 |
| 405 (present invention) | I-14/8th layer | 13 | −0.02 |
| 406 (present invention) | I-38/4th layer | 13 | −0.03 |
| 407 (present invention) | I-44/4th layer | 11 | −0.02 |

Comparative Compound g:

Compound as disclosed in JP-A-1-237543

-continued

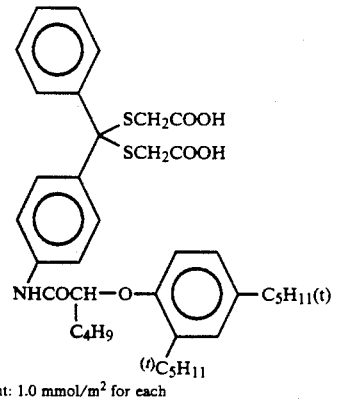

* Added amount: 1.0 mmol/m$^2$ for each

** Difference in sensitivity between 1 week storage at 55° C. and 80% RH and 1 week storage at 5° C.

The comparison of sensitivity was conducted at a point of fog + density of 0.2 with the sensitivity of red-sensitive layer of Specimen 401 as reference.

Table 3 shows that the light-sensitive material specimens comprising the present compounds exhibit an extremely excellent desilvering property, proving that a bleach accelerator effectively acts on during the processing. Further, the present compounds provide a higher sensitivity stability than Comparative Compound g.

On the other hand, Comparative Compounds d, e, and f were added to the blix bath in the processing step, respectively. Specimen 401 was then subjected to running processing in the processing baths, including the blix bath. The specimen was then wedgewise exposed to light, processed, and examined for the amount of residual silver in the same manner as mentioned above. As a result, only a slight desilvering effect could be observed as compared to the case where these comparative compounds were not used.

Comparative Compound d

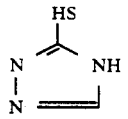

Comparative Compound e $HSCH_2COOH$

Comparative Compound f

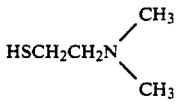

| Processing step | | | | |
|---|---|---|---|---|
| Step | Time | Temperature | Replenishment rate | Tank capacity |
| Color development | 3 min. 15 sec. | 38° C. | 45 ml | 10 l |
| Bleach | 1 min. 00 sec. | 38° C. | 20 ml | 4 l |
| Blix | 2 min. 00 sec. | 38° C. | 30 ml | 10 l |
| Washing (1) | 40 sec. | 35° C. | — | 4 l |
| Washing (2) | 1 min. 00 sec. | 35° C. | 30 ml | 4 l |

-continued

| Processing step | | | | |
|---|---|---|---|---|
| Step | Time | Temperature | Replenishment rate | Tank capacity |
| Stabilization | 40 sec. | 38° C. | 20 ml | 4 l |
| Drying | 1 min. 15 sec. | 55° C. | | |

*Determined per 35-mm width and 1-m length

The washing step was effected in a countercurrent process wherein the washing water flows backward.

The amount of the blix solution brought over to the rinse step was 2 ml per m of 35-mm wide light-sensitive material.

The various processing solutions had the following compositions:

| | Running solution | Replenisher |
|---|---|---|
| Color developer | | |
| Diethylenetriamine-pentaacetic acid | 1.0 g | 1.1 g |
| 1-Hydroxyethylidene-1,1-diphosphonic acid | 3.0 g | 3.2 g |
| Sodium sulfite | 4.0 g | 4.4 g |
| Potassium carbonate | 30.0 g | 37.0 g |
| Potassium bromide | 1.4 g | 0.7 g |
| Potassium iodide | 1.5 mg | — |
| Hydroxylamine sulfate | 2.4 g | 2.8 g |
| 4-[N-ethyl-N-(β-hydroxyethyl)amino]-2-methylaniline sulfate | 4.5 g | 5.5 g |
| Water to make | 1.0 l | 1.0 l |
| pH | 10.05 | 10.10 |
| Bleaching solution | | |
| Ferric ammonium ethylenediaminetetraacetate dihydrate | 120.0 g | Same as left |
| Disodium ethylenediaminetetraacetate | 10.0 g | " |
| Ammonium bromide | 100.0 g | " |
| Ammonium nitrate | 10.0 g | " |
| Bleach accelerator | 0.005 mol | " |

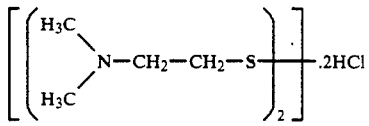

| | | |
|---|---|---|
| 27% Aqueous ammonia | 150.0 ml | Same as left |
| Water to make | 1.0 l | " |
| pH | 6.3 | " |
| Blix solution | | |
| Ferric ammonium ethylenediaminetetraacetate dihydrate | 50.0 g | Same as left |
| Disodium ethylenediaminetetraacetate | 5.0 g | " |
| Sodium sulfite | 12.0 g | " |
| 70% Aqueous solution of ammonium thiosulfate | 240.0 ml | " |
| 27% Aqueous ammonia | 6.0 ml | " |
| Water to make | 1.0 l | " |
| pH | 7.2 | " |

Washing solution

The running solution was used also as replenisher

Tap water was passed through a mixed bed column packed with an H-type strongly acidic cation exchange resin (Amberlite IR-120B available from Rohm & Haas) and an OH-type strongly basic anion exchange resin (Amberlite IRA-400 available from the same company)

so that the calcium and magnesium ion concentrations were each reduced to 3 mg/l or less. Dichlorinated sodium isocyanurate and sodium sulfate were then added to the solution in amounts of 20 mg/l and 150 mg/l, respectively. The washing solution thus obtained had a pH value of 6.5 to 7.5.

| Stabilizing solution (The running solution was used also as replenisher) | |
|---|---|
| 37% Formalin | 2.0 ml |
| Polyoxyethylene-p-monononylphenylether (mean polymerizatioh degree: 10) | 0.3 |
| Disodium ethylenediaminetetraacetate | 0.05 |
| Water to make | 1.0 l |
| pH | 5.0–8.0 |

EXAMPLE 5

An aqueous solution of silver nitrate and an aqueous solution of sodium chloride were simultaneously added to an aqueous solution of gelatin which had been kept at a temperature of 40° C. in the presence of $5.0\times10^{-6}$ mol of $(NH_4)_3RhCl_6$. Soluble salts were removed by a method known in the art. Gelatin was then added to the reaction system. The reaction system was not subjected to chemical ripening. 2-Methyl-4-hydroxy-1,3,3a,7-tetrazaindene was added to the reaction system as a stabilizer. Thus, a monodisperse emulsion of cubic grains with an average grain size of 0.2 μm was obtained.

The compounds as set forth in Table 4 were added to the emulsion in amounts as set forth in Table 4. A polyethyl acrylate latex was added to the emulsion in a solid content of 30 wt.% based on gelatin. 1,3-Vinylsulfonyl-2-propanol was then added to the emulsion as film hardener. The emulsion was coated on a polyester support in such an amount that the coated amount of silver and gelatin reached 3.8 g/m$^2$ and 1.8 g/m$^2$.Gelatin was further coated on the emulsion coat in an amount of 1.5 g/m$^2$ as a protective layer.

The specimens thus prepared were exposed to light through an optical wedge in a daylight printer Model P-607 available from Dainippon Screen Mfg. Co., Ltd. (Specimen A free of organic desensitizer was exposed to light with an ND filter having a density of 2.0 superimposed on the optical wedge), developed with the following developer at a temperature of 38° C. for 30 seconds, fixed, washed with water, and then dried.

| Developer | |
|---|---|
| Hydroquinone | 45.0 g |
| N-methyl-p-aminophenol ½ sulfate | 0.8 g |
| Sodium hydroxide | 18.0 9 |
| Potassium hydroxide | 55.0 9 |
| 5-Sulfosalicylic acid | 45.0 g |
| Boric acid | 25.0 g |
| Potassium sulfite | 110.0 g |
| Disodium ethylenediaminetetracetate | 1.0 g |
| Potassium bromide | 6.0 g |
| 5-Methylbenzotriazole | 0.6 g |
| 2-Mercaptobenzimidazole-5-sulfonic acid | 0.3 g |
| Sodium 3-(5-Mercaptotetrazole)benzo-sulfonate | 0.2 g |
| n-Butyl-Diethanol-amine | 15.0 g |
| Water to make | 1 l |
| pH | 11.6 |

The photographic properties were evaluated in the manner as described later. The results (Photographic Property 1) are set forth in Table 4.

The relative sensitivity was determined as reciprocal of the exposure giving a density of 1.5 upon development at 38° C. for 30 seconds relative to that of Specimen 1 as 100.

The black spot was determined by a 5-level evaluation under a microscope. Level 5 indicates the best quality, and Level 1 indicates the poorest quality. Level 5 and Level 4 are practicable. Level 3 is poor but is the lower limit of practical use. Level 2 and Level 1 are impracticable. A level in between Level 3 and Level 4 is represented as Level 3.5. A level in between Level 4 and Level 5 is represented as Level 4.5.

The black spot was evaluated upon development at 38° C. for 40 seconds.

Gradation (γ): Represented as inclination of the straight line between the points of a density of 0.3 and a density of 3.0 on the characteristic curve. The greater this value is, the higher is the contrast.

Another batch of these specimens which had not been processed were allowed to stand at a temperature of 50° C. and a relative humidity of 75% for 3 days, and then determined for photographic properties in the same manner as mentioned above. The results (Photographic Property 2) are set forth in Table 4.

TABLE 4

| Specimen No. | Added Amount of Compound A (mol/molAg) | Type of Present and Comparative Compounds | Added Amount of Present and Comparative Compounds (mol/molAg) | Photographic Property 1 | | | Photographic Property 2 | |
|---|---|---|---|---|---|---|---|---|
| | | | | Sensitivity | Gradation (γ) | Black Spot | Sensitivity | Gradation (γ) |
| 501 | $3\times10^{-4}$ | — | — | 100 | 12.1 | 3 | 98 | 11.7 |
| 502 | $4\times10^{-4}$ | — | — | 101 | 13.5 | 2 | 102 | 12.8 |
| 503 | $3\times10^{-4}$ | Compound II-4 | $5.4\times10^{-4}$ | 97 | 13.7 | 4 | 96 | 13.5 |
| 504 | $3\times10^{-4}$ | Compound II-5 | $5.4\times10^{-4}$ | 92 | 13.4 | 4.5 | 91 | 13.0 |
| 505 | $3\times10^{-4}$ | Compound II-1 | $5.4\times10^{-4}$ | 100 | 14.6 | 4 | 99 | 14.2 |
| 506 | $3\times10^{-4}$ | Compound II-24 | $5.4\times10^{-4}$ | 97 | 13.5 | 4 | 97 | 13.5 |
| 507 | $3\times10^{-4}$ | Compound II-10 | $5.4\times10^{-4}$ | 92 | 13.1 | 4.5 | 92 | 12.9 |
| 508 | $3\times10^{-4}$ | Compound II-16 | $5.4\times10^{-4}$ | 98 | 14.9 | 4 | 100 | 14.5 |
| 509 | $3\times10^{-4}$ | Comparative Compound a | $5.4\times10^{-4}$ | 88 | 11.6 | 4.5 | 78 | 9.0 |
| 510 | $3\times10^{-4}$ | Comparative Compound a | $1.1\times10^{-3}$ | 76 | 10.4 | 5 | 67 | 8.0 |
| 511 | $3\times10^{-4}$ | Comparative Compound b | $5.4\times10^{-4}$ | 90 | 12.0 | 4.5 | 79 | 9.2 |
| 512 | $3\times10^{-4}$ | Comparative Compound c | $5.4\times10^{-4}$ | 98 | 10.6 | 3 | 82 | 9.8 |

Compound A:

-continued

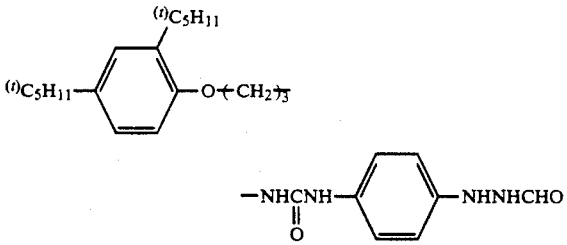

Comparative Compound a:

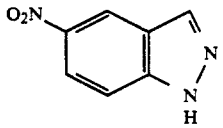

Comparative Compound b:
Hydrolyzable precursor as disclosed in U.S. Pat. No. 3,575,699)

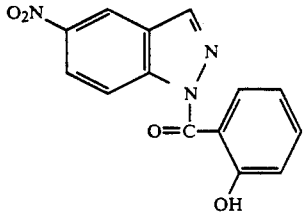

Comparative Compound c:
(Compound exemplified by general formula in JP-A-55-7576)

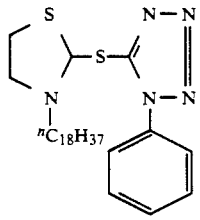

Table 4 shows that Specimens 501 and 502, free of the present compound, exhibit excellent sensitivity and gradation but exhibit a poor black spot characteristic.

Comparative Specimens 509 and 510, comprising Comparative Compound a, exhibit an excellent black spot characteristic but exhibit a low sensitivity and a low contrast. Further, Comparative Specimens 511 and 512, comprising extremely unstable Comparative Compounds b and c, exhibit a remarkable drop in sensitivity and gradation, particularly in a forced deterioration test (Photographic Property 2).

On the other hand, Specimens 503 to 508, comprising the compound of the general formula (II), exhibit excellent sensitivity, gradation and black spot characteristic. Further, Specimens 503 to 508 still exhibit excellent sensitivity and gradation in a forced deterioration test. As mentioned above, the present invention can provide a photographic image with an excellent sensitivity and gradation without deteriorating black spot characteristic. The present invention further can still provide an excellent sensitivity and gradation in a forced deterioration test.

The present invention also can provide improvements in safety to safelight, tone variability, and inhibition of stain due to reducer.

Furthermore, the present invention enables the presence of a bleach accelerator in a color light-sensitive material in a stable form even at an elevated temperature and high humidity and can provide an improvement in desilvering property.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising at least one silver halide emulsion layer on a support, characterized in that the emulsion layer and/or another hydrophilic colloid layer contains a compound represented by general formula (I):

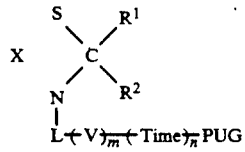

(I)

wherein $R^1$ and $R^2$ each represents a hydrogen atom, aliphatic group, aromatic group or heterocyclic group, with the proviso that $R^1$ and $R^2$ may be connected to each other to form a ring; L represents a divalent linking group; V represents a carbonyl group,

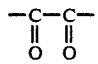

group, sulfonyl group, sulfoxy group,

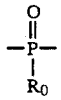

group (in which $R_0$ represents an alkoxy group or aryloxy group), iminomethylene group or thiocarbonyl group; Time represents divalent linking group; m represents an integer 0 or 1; n represents an integer 0 or 1; PUG represents a fog inhibitor, development inhibitor, development accelerator, fogging agent, coupler, coupler-releasing coupler, diffusive dye, nondiffusive dye, desilvering accelerator, desilvering inhibitor, silver halide solvent, competitive compound, developing agent, auxiliary developing agent, fixing accelerator, fixing inhibitor, image stabilizer, toner, processing dependency improver, dot improver, dye stabilizer, photographic dye, surface active agent, film hardener, ultraviolet absorbent, fluorescent brightening agent, desensitizer, contrast improver, chelating agent or DIR hydroquinone; and X represents an atomic group required to form a 5- or 6-membered ring with

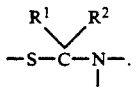

2. A silver halide photographic material as claimed in claim 1, wherein PUG is a fog inhibitor, development inhibitor, development accelerator, fogging agent, desilvering accelerator, desilvering inhibitor, silver halide solvent, developing agent, auxiliary developing agent, fixing accelerator, fixing inhibitor, image stabilizer, toner, processing dependency improver, dot improver, dye stabilizer, surface active agent, film hardener, desensitizer, contrast improver, chelating agent or DIR hydroquinone.

3. A silver halide photographic material as claimed in claim 1, wherein PUG is a fog inhibitor.

4. A silver halide photographic material as claimed in claim 1, wherein PUG is a development inhibitor.

5. A silver halide photographic material as claimed in claim 1, wherein PUG is a development accelerator.

6. A silver halide photographic material as claimed in claim 1, wherein PUG is a fogging agent.

7. A silver halide photographic material as claimed in claim 1, wherein PUG is a silver halide solvent.

8. A silver halide photographic material as claimed in claim 1, wherein PUG is a developing agent.

9. A silver halide photographic material as claimed in claim 1, wherein PUG is an auxiliary developing agent.

10. A silver halide photographic material as claimed in claim 1, wherein PUG is a DIR hydroquinone.

* * * * *